US010718183B2

(12) United States Patent
Bruce et al.

(10) Patent No.: US 10,718,183 B2
(45) Date of Patent: Jul. 21, 2020

(54) DOWNHOLE APPARATUS FOR DISRUPTING FILTER CAKE

(71) Applicant: HALLIBURTON MANUFACTURING AND SERVICES LIMITED, London (GB)

(72) Inventors: Stephen Edmund Bruce, Aberdeen (GB); David Grant, Aberdeen (GB); Ewan Colin Smith, Aberdeen (GB); Andrew David James Cameron, Aberdeen (GB)

(73) Assignee: HALLIBURTON MANUFACTURING AND SERVICES LIMITED, London (GB)

( * ) Notice: Subject to any disclaimer, the term of this patent is extended or adjusted under 35 U.S.C. 154(b) by 456 days.

(21) Appl. No.: 15/108,636

(22) PCT Filed: Nov. 5, 2014

(86) PCT No.: PCT/GB2014/053300

§ 371 (c)(1),
(2) Date: Jun. 28, 2016

(87) PCT Pub. No.: WO2015/101765

PCT Pub. Date: Jul. 9, 2015

(65) Prior Publication Data

US 2016/0326840 A1 Nov. 10, 2016

(30) Foreign Application Priority Data

Dec. 30, 2013 (GB) ..... 1323127.9

(51) Int. Cl.

| | |
|---|---|
| ***E21B 43/10*** | (2006.01) |
| ***E21B 37/02*** | (2006.01) |
| ***E21B 33/12*** | (2006.01) |
| ***E21B 37/06*** | (2006.01) |

(Continued)

(52) U.S. Cl.

CPC ..... *E21B 37/02* (2013.01); *E21B 33/12* (2013.01); *E21B 37/06* (2013.01); *E21B 43/088* (2013.01); *E21B 43/108* (2013.01); *E21B 21/003* (2013.01)

(58) Field of Classification Search

CPC ..... E21B 37/06; E21B 33/12; E21B 43/08; E21B 43/10

See application file for complete search history.

(56) References Cited

U.S. PATENT DOCUMENTS 2,503,719 A * 4/1950 Garrison ..... E21B 37/00 166/173

2,627,925 A 2/1953 Scivally (Continued)

FOREIGN PATENT DOCUMENTS

AU 2009285796 A1 3/2010
CN 1977027 A 6/2007

(Continued)

OTHER PUBLICATIONS

International Search Report and Written Opinion for International Application No. PCT/GB2014/053300 dated Oct. 7, 2015.

(Continued)

*Primary Examiner* — Robert E Fuller
*Assistant Examiner* — Lamia Quaim

(57) ABSTRACT

A tubular has a retracted configuration and an extended configuration. The tubular is initially in the retracted configuration and run into a bore at least partially lined with filter cake. The tubular is extended such that a filter cake-disrupting member mounted on the tubular defines high points or otherwise has an outer surface of varying radial extent for disrupting or disturbing the filter cake.

28 Claims, 22 Drawing Sheets

(51) Int. Cl.
*E21B 43/08* (2006.01)
*E21B 21/00* (2006.01)

(56) References Cited

U.S. PATENT DOCUMENTS

| | | | | |
|---|---|---|---|---|
| 2,710,657 | A | 6/1955 | Scivally | |
| 2002/0104649 | A1* | 8/2002 | Allen | B08B 9/0436 166/173 |
| 2010/0071898 | A1* | 3/2010 | Corre | E21B 33/12 166/264 |
| 2010/0175895 | A1* | 7/2010 | Metcalfe | E21B 33/1277 166/382 |
| 2013/0220643 | A1* | 8/2013 | Fripp | E21B 33/1208 166/387 |
| 2014/0090666 | A1* | 4/2014 | Thomas | E21B 37/02 134/8 |

FOREIGN PATENT DOCUMENTS

| | | | | |
|---|---|---|---|---|
| CN | 101718190 | A | 6/2010 | |
| CN | 101868513 | A | 10/2010 | |
| EP | 2458134 | A2 | 5/2012 | |
| GB | 2492193 | A | 12/2012 | |
| WO | WO-2000058602 | A1 | 3/2000 | |
| WO | 2009/001069 | A2 | 12/2008 | |
| WO | 2009001073 | A2 | 12/2008 | |
| WO | WO-2009001069 | A2 * | 12/2008 | E21B 33/1277 |
| WO | WO-2010025152 | A1 | 3/2010 | |
| WO | 2012066290 | A2 | 5/2012 | |
| WO | 2013/132254 | | 9/2013 | |
| WO | 2013/186569 | | 12/2013 | |

OTHER PUBLICATIONS

Tiffin, D. et al. "Evaluation of Filter Cake Flowback in Sand Control Completions" SPE International, Society of Petroleum Engineers, SPE European Formation Damage Conference, SPE 68933, 2001.

Alfenore, Jacques et al., "What really Matters In our Quest of Minimizing Formation Damage in Open Hole Horizontal Wells" SPE International, SPE International, Society of Petroleum Engineers, SPE European Formation Damage Conference, SPE 54731, 1999.

Bailey, L. et al., "Filtercake Integrity and Reservoir Damage" SPE International, Society of Petroleum Engineers, SPE 39429, SPE International Symposium on Formation Damage Control, 1998.

Beall, Brian B. et al., "Field Experience Validates Effectiveness of Drill-In Fluid Cleanup System" SPE International, Society of Petroleum Engineers, SPE 38570, SPE Annual Technical Conference and Exhibition, 1997.

Browne, S.V. et al., "Mudcake Cleanup To Enhance Productivity of High-Angle Wells" SPE International, Society of Petroleum Engineers, SPE 27350, SPE Intl. Symposium on Formation Damage Control, 1994.

Ryan, D.F. et al., "Mud Clean-Up in Horizontal Wells: A Major Joint Industry Study" SPE International, Society of Petroleum Engineers, SPE 30528, SPE Annual Technical Conference & Exhibition, 1995.

Sharma, Mukul M. et al., "Model simplifies filter cake lift-off pressure determination" Oil & Gas Journal, pp. 70-75, Nov. 1, 1999.

Zain, Zulkeffeli M. et al., "Cleanup of Wall-Building Filter Cakes" SPE International, Society of Petroleum Engineers, SPE 56635, SPE Annual Technical Conference and Exhibition, 1999.

Zain, Zulkeffeli M. et al., "Mechanisms of Mud Cake Removal During Flowback" SPE International, Society of Petroleum Engineers, SPE 58797, SPE International Symposium on Formation Damage Control, 2000.

The State Intellectual Property Office of the People's Republic of China, Application No. 201480076258.8, First Office Action and Search Report, dated Mar. 29, 2018, 9 pages, China.

The State Intellectual Property Office of the People's Republic of China, Application No. 201480076258.8, First Office Action and Search Report, dated Mar. 29, 2018, 9 pages, English Translation, China.

Canadian Intellectual Property Office, Application No. 2,935,482, Sep. 17, 2018, 5 pages, Canada.

* cited by examiner

Completion schematic with 3 off Darcy Screens

DOWNHOLE APPARATUS FOR DISRUPTING FILTER CAKE

REFERENCE TO RELATED APPLICATIONS

This application is a United States National Phase application of PCT Application No. PCT/GB2014/053300 filed on Nov. 5, 2014 which claims priority to United Kingdom Application No. 1323127.9 filed on Dec. 30, 2013.

FIELD OF THE INVENTION

This invention relates to a downhole apparatus. Embodiments of the invention relate to apparatus and methods for disrupting or disturbing filter cake or other residue from the walls of bores.

BACKGROUND OF THE INVENTION

In the oil and gas industry, bores or wells are drilled from surface to access subsurface hydrocarbon-bearing formations. During the drilling operation, it is conventional to circulate drilling fluid down through the drill string and up through the annulus between the string and the bore wall. The drilling fluid carries various materials, including solids, to provide the fluid with desired properties, and also serves to carry the cuttings generated by the drilling operation to surface. The drilling fluid is generally maintained at a pressure sufficient to prevent fluid contained in permeable formations intersected by the bore from passing into the bore. Thus, the drilling fluid is forced against the permeable bore wall under pressure and as a result a residue of fine material is deposited on the bore wall. This residue is known as filter cake and is generally considered to be desirable as the filter cake isolates the formation from the drilling fluid, minimising fluid leak-off to the formation, a poor filter cake may permit deep invasion of the reservoir by the drilling fluid and result in damage to the formation.

Removal of filter cake may be desirable at some stage in the preparation of the well for production, for example in preparation for cementing casing in the bore to ensure good contact and bonding between the cement and the wellbore wall. Such an operation may include the provision of a scratcher mounted on a joint of casing. A typical scratcher includes stiff wire fingers or cable loops extending outwards from a steel band. As the casing string is deployed into the well or bore or during reciprocation and/or rotation during circulation for clean-up or during cementing the scratcher disrupts and disturbs the filter cake. After lining and cementing, the liner may be perforated to allow production to commence.

Alternatively, or in addition, cleaning fluid may be circulated in the bore, the fluid containing "breakers," such as hydrochloric acid, enzymes or oxidative solutions. However, such an operation typically results only in partial cake removal.

Increasingly, production of formation fluids takes place through bore wall sections which have not been prepared in the conventional manner, by being lined, cemented and then perforated. For example, a completion may now include extended sand screen sections which are located in an extended unlined bore section. In such a situation, the presence of filter cake may have a more significant bearing on production. Indeed, it is often observed that only a very small fraction of the filter cake is removed by conventional methods, while most of the formation still remains covered by the cake. This condition results in only small portions of the flow area contributing to hydrocarbon inflow. Furthermore, once a small fraction of the formation is open to flow, there may be insufficient pressure gradient or differentials to remove the filter cake from other parts of the formation face.

WO 2009/001069 and WO 2009/001073, the disclosures of which are incorporated herein in their entirety, describe arrangements for supporting borehole walls and for applying predetermined stresses to borehole walls. Inflatable chambers are mounted on a base pipe such that inflation of the chambers increases the diameter of the assembly. The chambers may support a sand control element.

WO 2012/066290 and GB 2492193 A, the disclosures of which are incorporated herein in their entirety, describe other arrangements including inflatable chamber to support elements such as sand control screens.

SUMMARY OF THE INVENTION

According to an aspect of the present invention there is provided downhole apparatus including a tubular having a retracted configuration and an extended configuration, in the extended configuration, a filter cake-disrupting member mounted on the tubular defining high points or otherwise having an outer surface of varying radial extent for disrupting or disturbing filter cake.

According to another aspect of the invention there is provided a method of disturbing filter cake in a bore, the method including locating a tubular in a bore at least partially lined with filter cake, and activating the tubular to assume an extended configuration such that a filter cake-disrupting member mounted on the tubular defines high points or an outer surface of varying radial extent to disturb or disrupt the filter cake.

Embodiments of the present invention may permit or facilitate disruption or removal of filter cake from a section of the bore. Disrupting or removing filter cake from the bore wall may permit or facilitate a downhole operation to be carried out. For example, filter cake adhered to the bore wall may cause difficulties when performing any one of a production operation, injection operation, cementing operation, or the like. By disrupting or removing filter cake from the bore wall, the downhole operation may be facilitated. For example, when filter cake has been disrupted or removed from the bore wall, resistance to flow across the bore wall may be modified, for example decreased, thereby facilitating a production or injection operation, or the like. Disruption or removal of filter cake from the bore wall may facilitate, prepare or assist in preparing the bore wall for a cementing operation. Indeed, any downhole operation which involves filter cake removal, or disruption of filter cake, may be facilitated by embodiments of the present invention.

Disrupting a filter cake-lined portion of a bore may modify flow resistance across the portion. Flow resistance across a filter cake-lined portion of the bore may be decreased upon filter cake being disrupted therefrom. By decreasing flow resistance across the filter cake-lined portion of the bore, rate of fluid flow out of or in to the formation may be increased, decreased or controlled. Thus, disruption or removal of the filter cake adhered to the bore wall may facilitate a downhole operation to be carried out. For example, in some embodiments involving production of fluid from the formation, filter cake disruption or removal may result in a modified or an optimized rate of fluid production, for example, controlled, increased or decreased hydrocarbon production.

Further, by disrupting or removing filter cake from a section of the bore, production of fluid across the section may be optimized, increased, decreased, or evenly spread across the section, without having to rely on production fluid or other fluid removing filter cake when production is initiated. For example, production of fluid may be evenly or substantially evenly spread across the section of the bore so that production fluid may flow across the entire or some of the entire section of the bore, thereby preventing production fluid flow from being concentrated in an area of the bore where flow of production fluid has been initiated.

Further, by ensuring production of fluid may be evenly or substantially evenly spread across the section of the bore, coning effects, in which flow in to or out of the formation is concentrated in an area of the bore where filter cake has been disrupted or removed, may be reduced by facilitating flow of fluid to be evenly spread across the section of the bore in which filter cake has been disrupted or removed. By facilitating flow which is evenly spread across the section of the bore, production of certain fluids, for example water or the like, may be prevented or reduced. This may be relevant for deviated or horizontal bores in which the water level rises during production of hydrocarbons from the formation, and any area of the bore which produces fluid at a greater rate than other areas of the bore, may draw water up from the water level, thereby resulting in production of water in concentrated regions of the bore. Therefore, by disrupting or removing the filter cake across a spread-out section of the bore, hydrocarbon production may be maintained, while production of water may be reduced or prevented until the water level reaches the bore.

In other embodiments, an injection or cementing operation may be facilitated by virtue of the filter cake being disrupted or removed from a section of the bore. Damage to the bore wall or formation may be prevented or reduced by disrupting or removing filter cake so that fluid flow in to or out of the formation is not concentrated in one or more regions of the bore, but is instead spread along the section of bore in which filter cake has been removed.

The filter cake-disrupting apparatus may disrupt or remove the filter cake from the bore wall in any appropriate manner. Interaction between the filter cake-disrupting member, and the filter cake may disrupt or remove the filter cake. The filter cake may be disturbed, loosened, peeled, scraped, scratched or otherwise disrupted by the disrupting member contacting or penetrating the filter cake. Movement of the disrupting member with respect to the filter cake may disrupt or remove filter cake. Movement of the filter cake-disrupting member may be achieved by moving the tubular with respect to the bore, or may be achieved by moving the disrupting member with respect to the tubular.

The filter cake-disrupting member may have a retracted configuration and an extended or activated configuration. In some embodiments, extending or activating the tubular may extend or activate the filter cake-disrupting member. In the extended or activated configuration, the filter cake-disrupting member may disrupt or remove filter cake by contacting or penetrating the filter cake, or in any other appropriate manner.

In some embodiments, radial expansion of the disrupting member during activation may result in disruption or removal of the filter cake. For example, as the disrupting member is radially expanded, the disrupting member may contact or penetrate the filter cake. By contacting or penetrating the filter cake, the filter cake may be disrupted, disturbed or removed as the disrupting member is radially expanded onto or into the filter cake.

In some embodiments, during activation of the disrupting member, high points of the disrupting member may contact or penetrate the filter cake, thereby disrupting the filter cake. Once in the extended configuration and the high points are in contact with or penetrate filter cake on the bore wall, movement of the disrupting member relative to the bore wall may disrupt the filter cake.

In some embodiments, when the disrupting member has been activated, the disrupting member may contact or penetrate the filter cake. During or once activated, the disrupting member may be movable with respect to the bore wall. In some embodiments the disrupting member may be at least one of axially, radially, circumferentially, rotationally, reciprocally and oscillatory movable in the bore. In some embodiments any combination or sequence of axial, radial, circumferential, rotational, reciprocal or oscillatory movements in the bore may facilitate filter cake disruption or removal.

In some embodiments, fluid flow in the bore may facilitate disruption or removal of the filter cake. A downhole condition or parameter may be selected or controlled to initiate or control fluid flow. For example, a fluid parameter, for example a hydrostatic pressure, in a region of the bore may be selected in order to control a downhole condition in the bore. For example, a pressure gradient across a bore wall may be selected such that fluid flow in to or out of the formation may be controlled, initiated or inhibited, or the like. Any appropriate downhole condition or parameter may be selected or controlled in order to initiate, control or inhibit fluid flow in the bore.

In some embodiments, fluid flow may be controlled in any appropriate manner. For example, fluid flow may be controlled by pumping fluid downhole. In some embodiments fluid may be circulated in the bore or fluid flow may be controlled by selecting or controlling at least one of a fluid parameter, and fluid flow pumped from or to surface, and from or to a downhole tool, and fluid flow from or to the formation, and the like.

In some embodiments, combining fluid flow with mechanical movement of the filter cake-disrupting member may disrupt or remove filter cake. In some embodiments, any movement of the disrupting member with respect to the filter cake may disrupt or remove filter cake, and any fluid flow with respect to the disrupted or removed filter cake may result in further disruption or removal of the filter cake. In some embodiments, fluid flow may carry removed filter cake from one section of the bore to another section of the bore, or to surface.

The filter cake-disrupting member may take any suitable form. In the retracted configuration the member may have a substantially regular or smooth outer surface, for example the member may be substantially cylindrical. This may facilitate translation of the tubular through a well bore. The disrupting member may be configured such that, as the member is extended or activated, disrupting portions of the member extend radially beyond other portions of the member. As the tubular is activated and radially extended, portions of the disrupting member may move across or into the bore wall. In other examples, in the extended configuration, the disrupting member may be configured such that as the member is extended, disrupting portions of the member provide a substantially regular or smooth outer surface.

In some embodiments the disrupting member may include a shroud. The shroud may provide protection for a downhole tool provided under or within the shroud. For example, the tubular may be protected by the shroud. The shroud may thus provide a filter cake disrupting function as well as protecting the downhole tool or tubular.

The filter cake-disrupting member may take the form of a slotted tubular member, the slotted tubular member being configured such that on activation, on the circumference or diameter of the slotted tubular member increasing, the slots deform and the portions of the slotted tubular member defining the walls of the slots move out of a common plane. The slots may extend in any suitable direction, and may extend axially of the slotted tubular member.

The filter cake-disrupting member may include a movable portion having a retracted configuration and an extended configuration, in the extended configuration the movable portion may contact or penetrate the filter cake.

The disrupting member may include a plurality of movable portions. Each of the movable portions may be independently movable, or the movable portions may move in sequence, together at the same time, or in any other appropriate manner.

The movable portion may be lockable or otherwise retained in the retracted configuration. Upon activation, the movable portion may be unlocked, deformed or released to assume the extended configuration.

The movable portion may include at least a portion of the tubular. For example, the movable portion may be an integral part of the tubular, or may be a separate component of the tubular.

The filter cake-disrupting member may include a movable portion which is initially restrained in a retracted configuration. The portion may be unlocked, released or deformed to assume an extended or active configuration. The portion may be unlocked, deformed or released upon expansion of the tubular. For example, the member may include circumferentially extending fingers having restrained tips, and on the tubular being activated the tips are released and the fingers extend radially outwards of the tubular.

The movable portion may be provided in any appropriate form such that when activated, the movable portion may move from the retracted to the extended configuration. The movable portion may be radially, circumferentially, or otherwise movable with respect to the tubular. Upon activation, at least a portion of the movable portion may contact or penetrate filter cake.

The filter cake-disrupting member may be provided in any appropriate axial or circumferential arrangement.

The filter cake-disrupting member may extend axially along the tubular. The disrupting member may be circumferentially wrapped around the tubular. The disrupting member may be wrapped helically around the tubular.

The filter cake-disrupting member may extend part-circumferentially or fully-circumferentially around the tubular. For example, the filter cake-disrupting member may include a number of movable portions mounted around the tubular and arranged such that 360 degree disrupting member-coverage is provided around the tubular.

The filter cake-disrupting member may be configured depending on downhole conditions. For example, the downhole conditions such as rock type, temperature, pressure, or other fluid and rock parameters, may affect which type of filter cake-disrupting member is most effective in disrupting filter cake.

The filter cake-disrupting member may include a filter cake-engaging element for contacting or penetrating filter cake, thus assisting in disrupting filter cake.

The filter cake-engaging element may include any appropriate shape for disturbing, loosening, peeling, scraping, scratching or otherwise disrupting filter cake. The shape of the element may be configured to provide maximum or enhanced disturbance of filter cake.

The engaging element may include a material having sufficient strength or resilience to cope with downhole conditions and frictional forces generated by movement of the disrupting member with respect to the bore wall. For example, the material may include any one of titanium, tungsten carbide, diamond, or the like.

The tubular may be movable in any way within the bore. The tubular may be moved in an axial direction within the bore, for example, in a single axial direction. The tubular may be reciprocated within the bore, for example, the tubular may be moved axially back and forth. The tubular may be rotated within the bore, for example, the tubular may be rotated in one or both angular directions, or the tubular may be oscillated in both angular directions. By moving the tubular within the bore, the filter cake-disrupting member may disrupt or remove filter cake during movement across a section of the bore wall lined with filter cake.

The tubular may be moved in any combination of different ways. The tubular may be moved in any combination or sequence of at least one of axial, reciprocal and rotational movement within the bore. For example, the tubular may be reciprocated and rotated within the bore in sequence, in separate steps, or simultaneously reciprocated and rotated.

In some examples, the tubular may be run in hole in the retracted configuration to a first position within the bore. Once in the first position the tubular may be activated to assume the extended configuration. Once in the extended configuration, the tubular may be moved to a second position. The second position may be any axial or rotational position of the tubular within the bore. When in the extended configuration, the tubular may be moved between the first and second positions such that the filter cake-disrupting member disrupts or removes the filter cake.

The tubular may take any appropriate form. The tubular may include or form part of a downhole tool.

The tubular may include or form part of a completion element. The tubular may be suitable for providing sand or formation control.

The tubular may include a sand screen.

The tubular may include a perforated tubular.

The tubular may include an expandable screen.

The tubular may include a wire-wrapped screen.

The tubular may include a gravel pack screen.

The tubular may be configured such that production fluid may flow from a surrounding formation and into or along the tubular. The action of the filter-cake disturbing member may thus facilitate fluid production. Similar advantages may accrue in an injection well, where fluid is flowing from the well into the surrounding formation. For example, the tubular may be configured such that injection fluid may flow from the tubular and into a surrounding formation.

Alternatively, the apparatus may be provided as a stand-alone apparatus for disrupting filter cake. For example, the stand-alone apparatus may be provided for the disrupting filter cake and then may be retrieved to surface or released downhole without carrying out any other downhole operation. The tubular may be returned to surface by deactivating the tubular or disrupting member such that the tubular returns to the retracted configuration to enable return to surface through restricted potions of the bore.

The apparatus may include or form part of a sub-assembly. The sub-assembly may include or form part of the tubular. The sub-assembly may include or form part of the filter cake-disrupting member. The apparatus may form part of a well completion, the filter cake-disrupting member may be activated to remove or disrupt filter-cake as part of setting the well completion. The apparatus may be left downhole as part of a completion, that is, the apparatus may be left in place permanently.

The disrupting member or the tubular may be activated in any appropriate manner.

The tubular may include an actuating member arranged to extend the filter cake-disrupting member upon an actuating signal being received by the actuating member. The actuating signal may be sent to actuate the actuating member to extend the disrupting member.

The actuating signal may be provided in any appropriate form. The actuating signal may be in the form of fluid pressure applied to the actuating member, which pressure may activate the filter cake-disrupting member to the extended configuration. For example, the actuating member may be in fluid communication with the surface of the wellbore so that pressure applied from the surface may activate the filter cake-disrupting member.

The actuating signal may be delivered by pumping a trigger, for example a radio-frequency identification (RFID) tag, to the activating member in order to initiate activation of the disrupting member.

The actuating signal may be in the form of a force applied to the actuating member by a downhole tool, which force activating the filter cake-disrupting member to the extended configuration. For example, a force applied via a wireline or a string may activate the disrupting member. The tubular may include a motor arranged to actuate the actuating member.

The actuating member may include a retaining member to initially retain or lock the disrupting member in the retracted configuration. The retaining member may be configured to release or unlock the disrupting member in order activate or to permit activation of the disrupting member. The retaining member may take any appropriate form. For example, the retaining member may include a pin, shear pin, or the like.

In some examples the tubular may include a base pipe and a plurality of inflatable chambers mounted thereon. The filter-cake disrupting member may be mounted externally of the chambers. Inflation of the chambers causes the diameter of the tubular to increase and may actuate or activate the filter cake-disrupting member. The tubular may also provide mounting for a filter member or weave, which may be mounted below the filter-cake disrupting member. In some embodiments the filter cake-disrupting member may be mounted on or coupled to the chambers. In some embodiments the filter cake-disrupting member may be mounted on a different apparatus or structure. For example, the member may be mounted on an alternative or otherwise conventional sand screen assembly, or may be provided as a stand-alone item, for example mounted on a small sub configured to activate the member when desired, which activation may be achieved mechanically, by pressure, or by some other means.

In some examples, the tubular may include an inflatable bladder or chamber arranged to activate the filter cake-disrupting member. Upon inflation, the bladder or chamber may expand to activate the disrupting member.

In other examples, the tubular may include a sliding sleeve or piston arranged to activate the filter cake-disrupting member. The sliding sleeve or piston may be slidably coupled to a housing. Upon activation of the sleeve or piston, the sleeve or piston may move relative to the housing such that a portion of the sleeve or piston contacts the filter cake-disrupting member, moving the disrupting member into its extended configuration. For example, the filter cake-disrupting member may be in the form of a dog movably coupled to the housing, the sleeve or piston contacting the dog such that the dog moves outwardly of the housing, thereby activating the disrupting member. In other examples, the disrupting member may be in the form of a deformable member. The sleeve or piston may compress or otherwise cause the deformable member to deform outwardly, thereby activating the disrupting member.

In other examples, the tubular may include a collet member arranged to progress along or within the tubular. The collet member may be progressed in any appropriate manner, for example, an object may be placed or pumped downhole to progress the collet member. Upon reaching an activation site, the collet member may activate the disrupting member in any appropriate manner.

In other examples, the tubular may include a swellable material arranged to swell upon exposure to any appropriate material, for example any one of water, oil, and a hybrid mixture of water and oil. The disrupting member may be coupled to or mounted on the swellable material such that upon swelling, the disrupting member is activated.

The tubular may include any appropriate downhole tool for performing a downhole operation. In some examples, the tubular may include a stimulation tool for restoring or enhancing productivity of a formation. In other examples, the tubular may include a jetting tool for eroding material in a formation.

The filter cake-disrupting member may disrupt filter cake such that disrupted filter cake may be further disturbed or removed by fluid flow. For example, the high points defined by the member may penetrate and dislodge the filter cake, facilitating disruption of the filter cake by subsequent flow.

The presence and properties of fluid in the bore may be controlled according to downhole conditions, for example, hydrostatic balance, formation pressure, flow-rate, and the like.

The downhole conditions in the bore may be varied such that the formation may produce fluid. For example, the pressure of the fluid in the bore may be reduced such that a pressure gradient is achieved between the formation and the bore to allow formation fluid to flow into the bore. However, the presence of filter cake on the bore wall, along with appropriately pressure-balanced fluid in the bore, may prevent or restrict initiation of flow from the formation. By removing filter cake from the bore wall, when flow of fluid in to or out of the formation is required, the rate of fluid flow may be optimized or increased by virtue of the increased bore wall permeability resulting from filter cake removal. Filter cake may be disrupted or removed from the bore wall to optimise or increase the rate of fluid flow produced by the formation. The downhole conditions may be controlled in order to prevent uncontrolled flow in to or from the formation.

Fluid flow may be achieved in the bore by pumping fluid downhole or by allowing fluid to flow from the formation, or by allowing fluid to flow into the formation. Fluid flow may be provided by at least one of varying or controlling a downhole condition, pumping fluid downhole, allowing fluid to flow from the formation, and allowing fluid to flow into the formation. In some examples, fluid may be pumped downhole and circulated through the bore.

By disrupting or removing filter cake, damage or blockage on the bore wall or in formation pores may be reduced. In this manner, the flow resistance across the bore wall may be reduced such that the rate of fluid flow across the bore wall may be increased. Reducing or removing filter cake adherence to the bore wall may therefore facilitate downhole operations involving production or injection.

Filter cake removed from the bore wall by fluid flow may be carried to another part of the bore, or to surface. Removing filter cake in this manner may facilitate well clean up.

Fluid may be flowed across a filter cake-lined section of the bore wall at least one of before, during and after the filter cake is disrupted by the disrupting member. Movement of the disrupting member may disrupt the filter cake, and fluid flow may assist in removal of disrupted or removed filter cake.

The fluid may include any appropriate fluid for facilitating disturbing, disrupting, removing or breaking-down filter cake. The fluid may be selected according to downhole conditions and the properties of the filter cake.

The fluid may be configured to act mechanically on the filter cake. The fluid may be configured to act chemically on the filter cake. The apparatus may be configured so that the fluid may act mechanically on the filter cake. The apparatus may be configured to that the fluid may act chemically on the filter cake. Combined mechanical and chemical action may enhance filter cake disruption or removal from the bore wall. Combined mechanical and chemical action may enhance filter cake disruption or removal from the bore wall.

The fluid may include a scouring fluid for disrupting or removing filter cake.

The fluid may include a breaker for disrupting or removing filter cake.

The fluid may include an abrasive fluid, for example, the fluid may include an angular sand, or the like. Fluid flow may enhance abrasive action of the fluid, facilitating breakdown and removal of filter cake from the bore wall.

The fluid may include a chemical for breaking-down, assisting to break-down, or dissolving the filter cake, for example, any one of an acidic fluid, an oxidative solution, a solubilising fluid, an enzyme, and the like.

The apparatus may include an isolation device for restricting, preventing, diverting or controlling flow in a bore. The isolation device may be mounted on the tubular or a tubing component. The tubing component may form part of a string. The isolation device may restrict, prevent, divert or control flow in the annulus between the tubular or tubing component and the bore wall. Provision of the isolation device may prevent uncontrolled fluid flow in to or from the formation.

By restricting, preventing, diverting or controlling flow in the bore, the isolation device may allow downhole fluid pressure or fluid composition to be controlled, or may allow fluid carrying removed filter cake to be transported elsewhere in the bore or to surface, or may prevent fluid from migrating across the isolation device.

The isolation device may be configured to allow fluid to flow from one side of the isolation device to the other side. For example, the isolation device may include a valve or a diverter for allowing fluid to bypass the isolation device. The valve or diverter may allow fluid to pass through the isolation device, or may allow fluid to be diverted into the tubular or the tubing component. Fluid may then be transported to a separate part of the bore, string, or to surface.

The isolation device may have a retracted configuration in which the isolation device is fixable in place on the tubular or tubing component, and an extended or activated configuration in which the isolation device is fixable in place in a section of a wellbore or casing, the tubular or tubing component being movable through a bore of the isolation device.

The isolation device may include a seal element in the bore of the isolation device for providing a seal when the tubular or tubing component is provided in the bore of the isolation device, such that the seal element contacts the surface of the tubular or tubing component to provide the seal, thereby preventing fluid flow through the bore of the isolation device. The seal element may be configured to allow the tubular or tubing component to be moved in any manner within the bore of the isolation device, for example, the tubular or tubing component may be lowered, raised, reciprocated or rotated within the bore of the isolation device. The seal may be provided when the isolation device is in the retracted configuration. The seal may be provided when the isolation device is in the extended or activated configuration. The seal may be provided during movement of the tubular or tubing component through the bore of the isolation device.

In use, the tubular or tubing component and the isolation device may be run downhole to a predetermined location with the tubular or tubing component provided in the bore of the isolation device. In this manner, the isolation device may be carried downhole and deployed in the predetermined location. The isolation device may be extended or activated to restrict flow through the annulus between the tubular or tubing component and the bore wall, in the predetermined location. Once the isolation device has been extended and fixed in place in the predetermined location, the tubular or tubing component may be movable within the bore of the isolation device. In this manner, the tubular may be moved or manipulated in any appropriate manner to allow the disrupting member to disrupt or remove filter cake from the bore wall.

In some examples, the tubular or tubing component may be joined to other tubular or tubing components. The tubular or tubing components may have the same cross-sectional profile such that joined tubular or tubing components can be moved within or through the bore of the isolation device, without joints between the tubular or tubing components impeding movement of the tubular or tubing component through the bore of the isolation device. In some examples, the tubular or tubing component may be in the form of flush joint tubing in which the gap between the tubular or tubing components is minimised. In this manner, the tubular may be axially moved within the bore over a greater distance than the length of the tubular or a single tubing component.

The isolation device may be fixed with respect to the tubular or tubing component. Where the isolation device is fixed with respect to the tubular, the tubular may be prevented from moving within the bore once the isolation device has been activated or set. However, a separate component of the tubular or disrupting member may be configured to allow the separate component of the tubular or disrupting member to be moved with respect to the bore so that filter cake can be disrupted.

The isolation device may be set in any appropriate location within the bore. The isolation device may be set in an open hole section of the bore. The isolation device may be set in a lined section of the bore, for example, a section of the bore lined with casing. Once set in the lined section, the isolation device may prevent fluid from migrating or flowing from the lined section of the bore to an unlined section of the bore. However, the isolation device may be configured to allow fluid in the unlined section of the bore to flow into the lined section of the bore. In this manner, fluid in the lined section of the bore is prevented from contaminating the fluid in the unlined section of the bore. Alternatively, the isolation device may be configured to allow fluid to flow from the lined section to the unlined section, but prevent fluid flow from the unlined section to the lined section.

In some embodiments, one or more isolation devices may be set or activated in an open hole section. By providing an isolation device in an open hole section, individual or multiple formation zones may be isolated.

The apparatus may include or form part of a string.

The isolation device may include a packer, for example, a swellable packer or an expandable packer. The isolation device may be activated or set in any appropriate manner.

A plurality of isolation devices may be provided for isolating zones in the bore.

According to a further aspect there is provided an apparatus for cleaning a filter cake-lined section of a bore wall, including a filter cake-disrupting apparatus actuatable between a pre-disrupting configuration and a disrupting configuration.

According to a further aspect there is provided a method of cleaning a filter cake-lined section of a bore wall, including providing a filter cake-disrupting apparatus in a pre-disrupting configuration, running the apparatus to the filter cake-lined section, actuating or activating the apparatus to a disrupting configuration, and disrupting a portion of filter cake.

According to a further aspect there is provided an assembly, including a filter cake-disrupting apparatus actuatable between a pre-disrupting configuration and a disrupting configuration, and an isolation device.

According to a further aspect there is provided a method of cleaning a filter cake-lined section of a bore, the method including providing a filter cake-disrupting apparatus in a pre-disrupting configuration, running the apparatus downhole and isolating a portion of the bore to provide a seal, running the apparatus to the filter cake-lined section, and activating the apparatus to a disrupting configuration and disrupting a portion of filter cake.

In the pre-disrupting configuration the disrupting apparatus may be dimensioned to pass through a restriction in the bore, for example, a section of casing. In the disrupting configuration the apparatus may be dimensioned to contact a portion of the bore wall lined with filter cake.

In use, the apparatus may be provided in the pre-disrupting configuration and run through the restriction to an open hole section, wherein the diameter of the open hole section is larger than the diameter of the restriction. In the open hole section, the apparatus may be actuated or activated to the disrupting configuration. During actuation or activation, the disrupting member may disrupt a portion of filter cake. When provided in the disrupted configuration, the disrupting member may disrupt a portion of filter cake. The disrupting member may be movable relative to the bore wall such that during movement, the disrupting member disrupts a portion of filter cake from the bore wall.

Reducing the amount of filter cake adhered to the bore wall may result in the thickness or density of filter cake being reduced relative to the pre-disrupted thickness or density of filter cake. Disrupting a portion of filter cake may result in increased permeability of the filter cake portion relative to the pre-disrupted permeability of the portion of filter cake. Disrupting the portion of filter cake may therefore facilitate a production or injection operation in a formation adjacent the disrupted portion of filter cake.

The portion of the bore may be isolated by an isolation device. The isolation device may restrict, prevent, divert or control flow in the bore such that fluid flow in to or out of the formation is controlled, thereby preventing uncontrolled fluid flow in to or out of the formation. By restricting, preventing, diverting or controlling flow in the bore, the isolation device may allow downhole fluid pressure or fluid composition to be controlled, or may allow fluid carrying removed filter cake to be transported elsewhere in the bore, or to surface.

The disrupting member and isolation device may include or form part of a string.

It will be apparent to the skilled person that individual features of the various aspects of the invention as described above, as described in the following detailed description, and as set out in any of the appended claims, may be combined, individually or in combination, with features of other aspects and embodiments of the invention, as appropriate.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
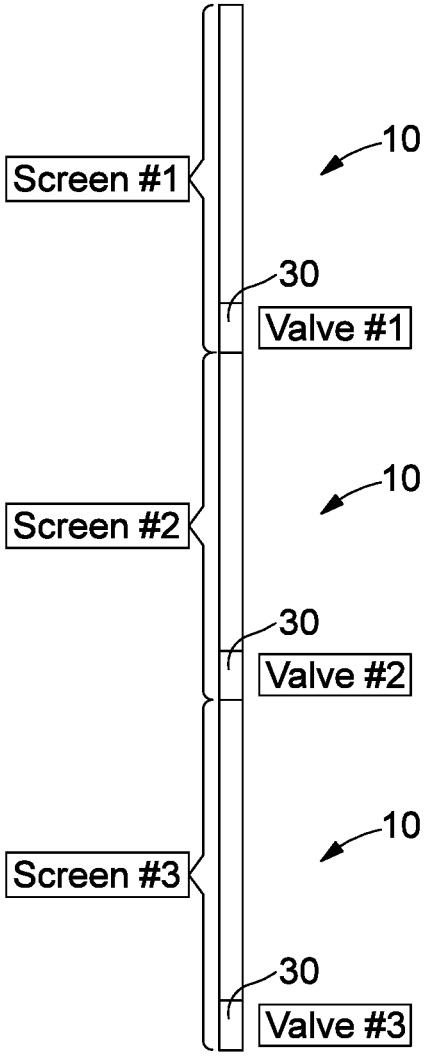
FIG. 1 is a schematic illustration of part of a completion including three sand screens.

Reference is first made to FIG. 1 of the drawings, which is a schematic illustration of part of a well bore completion including three sand screens 10, similar to those described in GB 2492193 A. Features of such screens 10 may be utilized in combination with embodiments of the present invention, as will be described. Of course the completion will include many other elements and devices not shown in the drawing, such as a shoe on the leading end of the completion, packers for zonal isolation, hangers, valves and the like. Typically a completion will incorporate more than one screen, the number of screens being selected as appropriate.

The screens 10 are run into the hole in a retracted or smaller diameter configuration and subsequently activated to assume a larger diameter configuration, in which the outer surface of the screens engages the bore wall of an unlined bore section.

Figure 2:
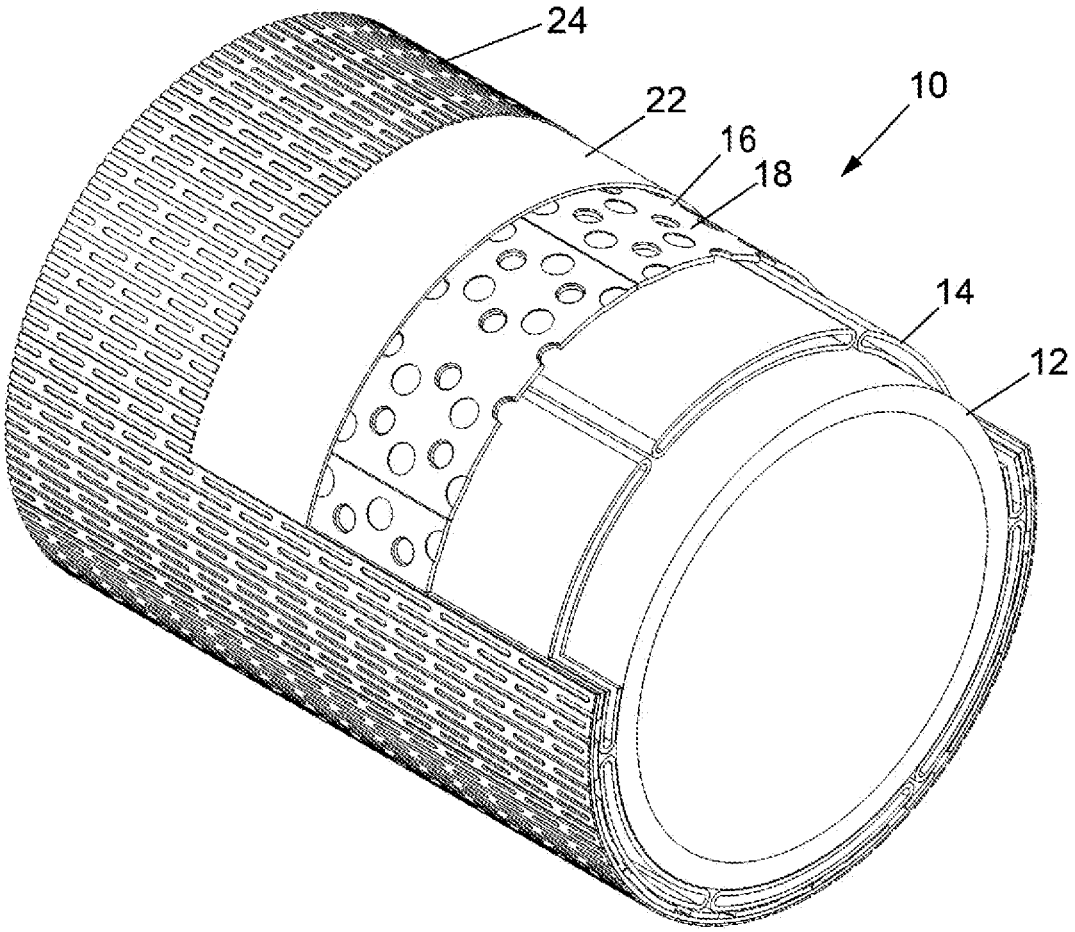
FIG. 2 is a part cut-away view of part of one of the screens of FIG. 1.
Figure 3:
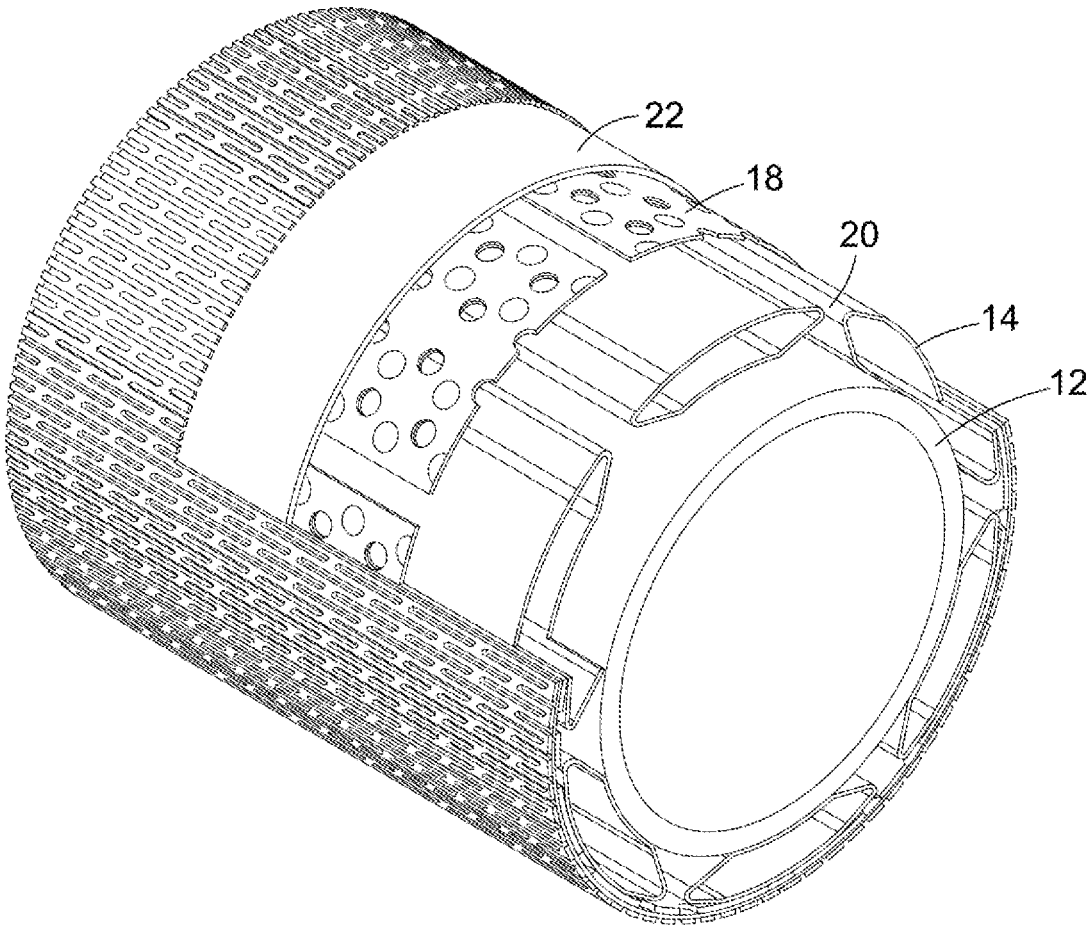
FIG. 3 corresponds to FIG. 2 but shows the screen in an activated configuration.

FIG. 2 of the drawings illustrates a part cutaway view of part of one of the screens 10 of FIG. 1, showing the screen 10 in an initial configuration. The screen 10 includes a base pipe 12 providing mounting for, in this embodiment, six activation chambers 14 which extend axially along the outer surface of the base pipe 12. The chambers 14 are arranged side-by-side around the base pipe 12 and may be inflated or deformed by filling the chambers 14 with high pressure fluid such that the chambers 14 assume an activated configuration, as illustrated in FIG. 3 of the drawings.

A drainage layer 16 is located externally of the chambers 14, in this embodiment the layer 16 including six strips 18 of apertured or perforated steel sheet. Like the chambers 14, the strips 18 are arranged side-by-side and extend axially along the screen 10, but are circumferentially offset relative to the chambers 14, as illustrated in the drawings, such that when the chambers 14 are extended, the strips 18 bridge the gaps 20 formed between the chambers 14.

The drainage layer 16 supports a filter media in the form of a weave 22. The weave 22 may include a single length of material wrapped around the drainage layer 16 with the longitudinal edges overlapping, or may include two or more lengths or strips of material. A protective shroud 24 is provided over the weave 22.

Figure 5:
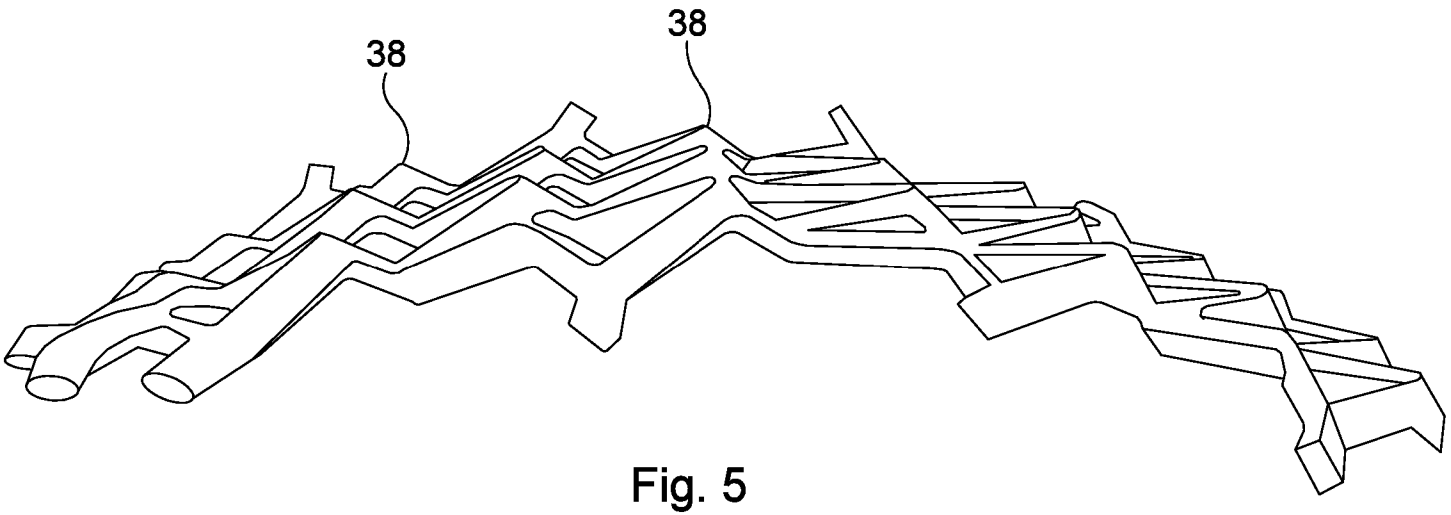
FIGS. 5 and 6 are perspective views of a portion of a filter cake-disrupting shroud formed of the material of FIG. 4, following activation.
Figure 6:
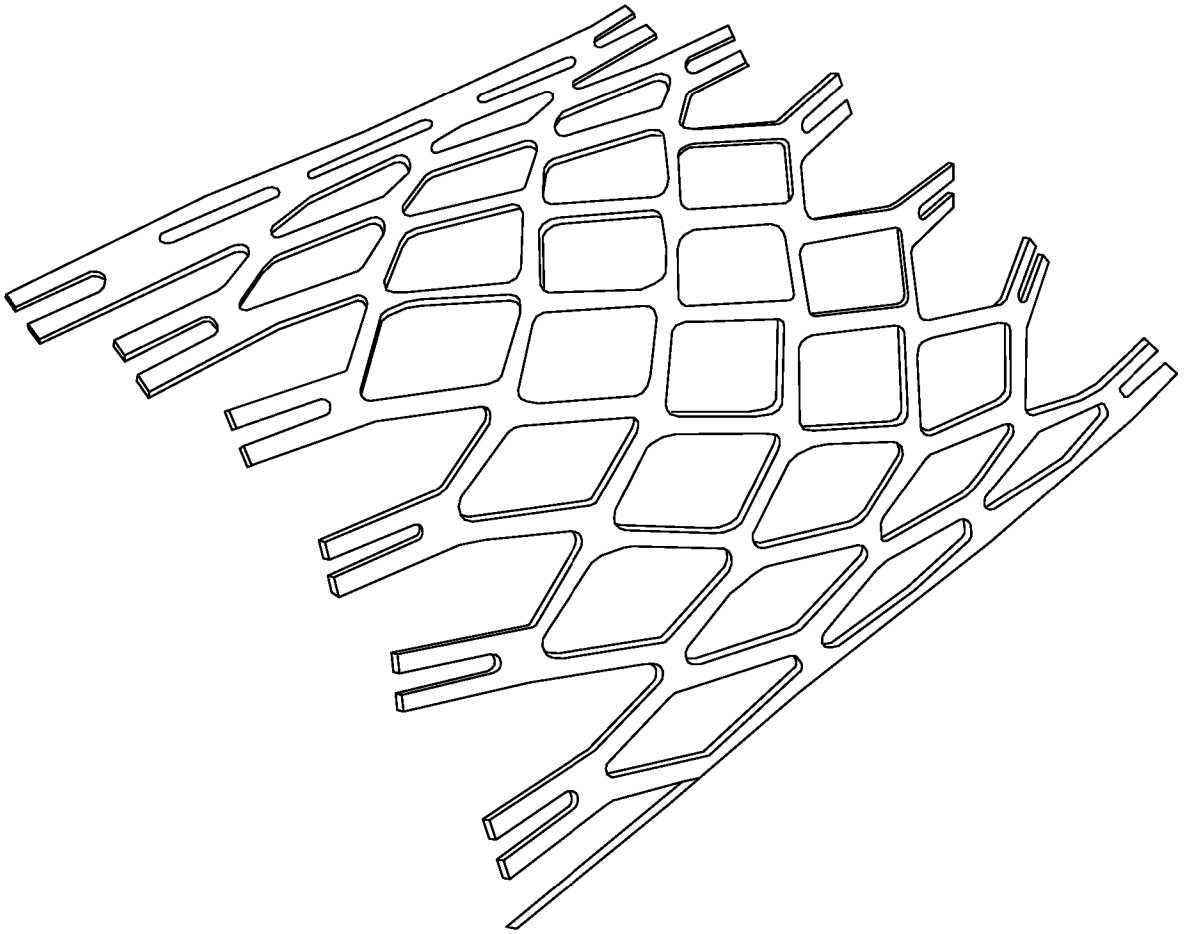

The primary purpose of a conventional shroud is to protect the weave 22 as the completion is run into the well bore, and further to protect the weave 22 from direct contact with the wall of the well bore when the screen 10 is expanded into contact with the wall. A conventional shroud will maintain a generally smooth cylindrical form as the shroud is extended with activation of the screen 10. However, in a first embodiment of the invention, as illustrated in FIGS. 4, 5 and 6 of the drawings, the shroud is formed of slotted sheet 30 which is configured to assume an irregular or jagged outer form on activation of the screen 10.

Figure 4:
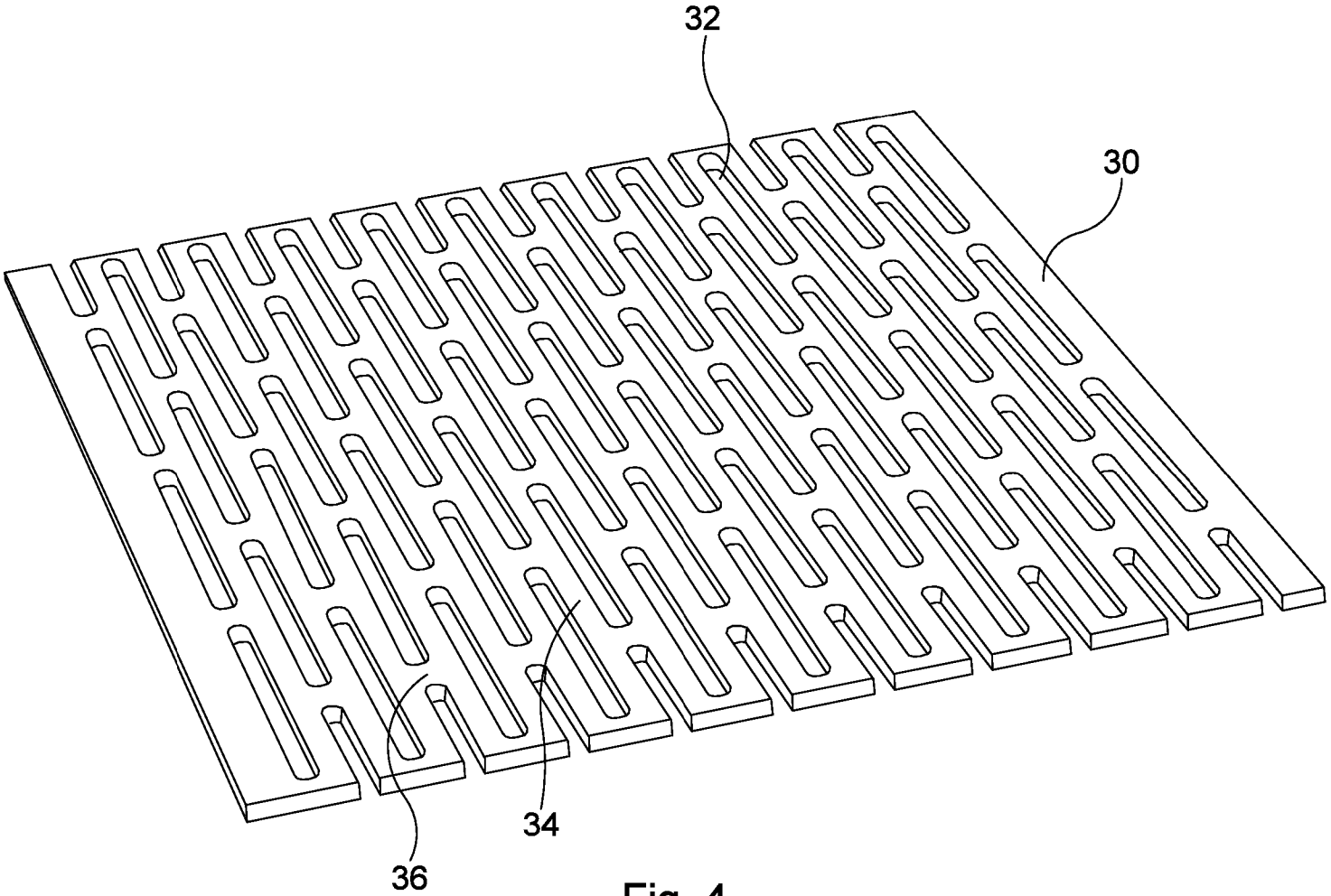
FIG. 4 is a perspective view of a sheet of material as utilized to form a filter-cake-disrupting shroud in accordance with an embodiment of the present invention.

The sheet 30 may be initially provided as a solid planar sheet which is then punched to form a multitude of axially extending overlapping slots 32, as illustrated in FIG. 4. The punched sheet 30 is then formed into a cylinder and may be located on and secured to the screen 10.

A completion including the screens may then be run into a well bore. On reaching the required depth, the screens 10 are activated, the inflating chamber 14 pushing the slotted shroud 24 out towards the well bore wall, which will be lined with filter cake. As the shroud 24 is extended, the slots 32 open and assume a diamond-shaped form, as illustrated in FIGS. 5 and 6. The slots 32 are sized and spaced such that the axial webs 34 are thinner and weaker that the circumferential webs 36. The webs 34, 36 are also wider than they are deep. As a result, the extension of the shroud is accommodated at least in part by distortion of the sheet material, primarily by bending of the axial webs 34 where the axial webs 34 meet the circumferential webs 36 around a circumferential axis. This results in inclination of the webs 34, 36 such that, while retaining a generally cylindrical form, the exterior of the shroud assumes a jagged or toothed profile. The high spots 38 thus created are pushed radially outwards and into and through the filter cake to disturb and dislodge the filter cake. Of course this will facilitate flow of fluid from the surrounding formation into the bore and then through the sand-control element and into or along the base pipe and into the apparatus bore.

Figure 7:
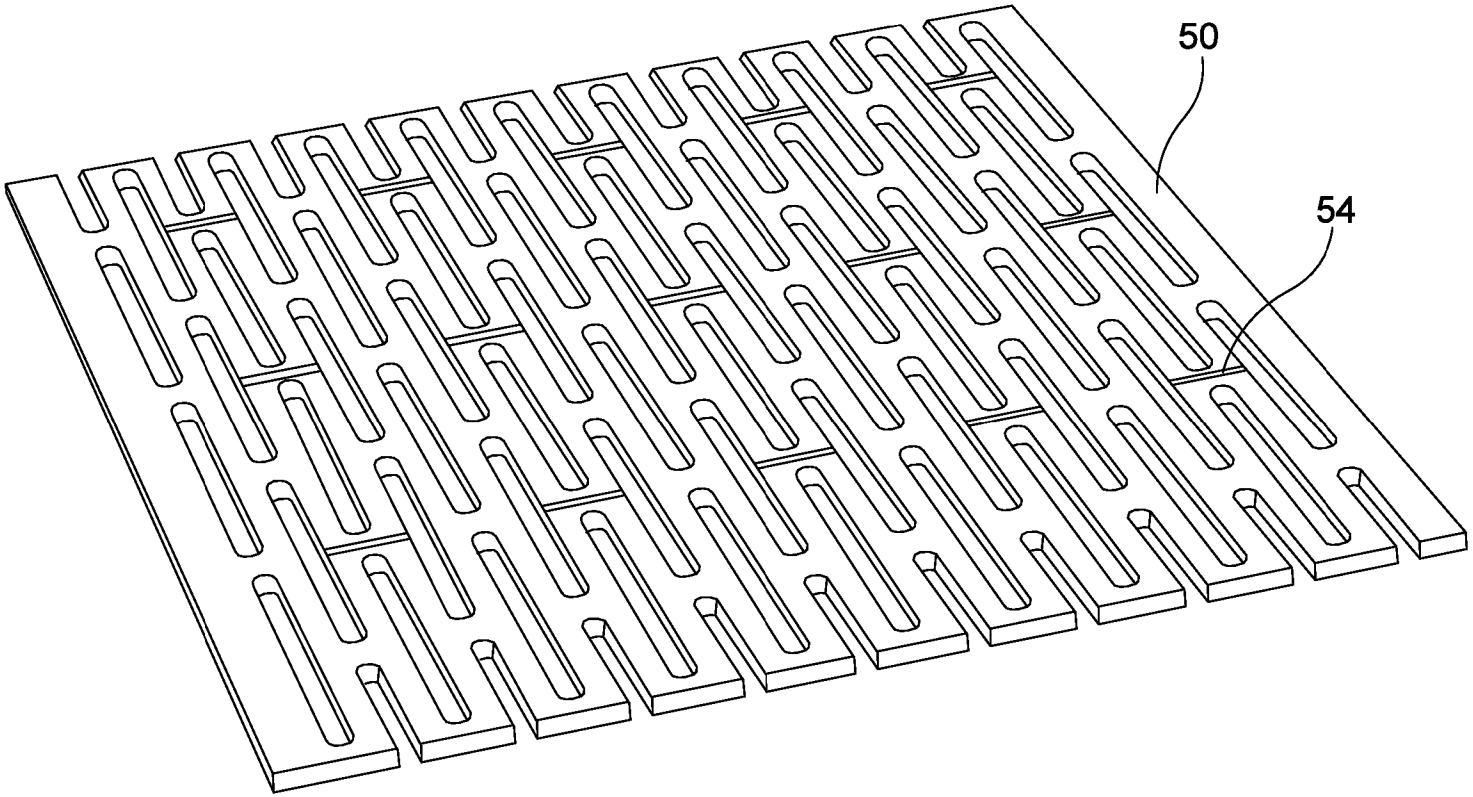
FIGS. 7 and 8 are perspective views of sheet material utilized to form a filter-cake-disrupting shroud in accordance with further embodiments of the present invention.
Figure 8:
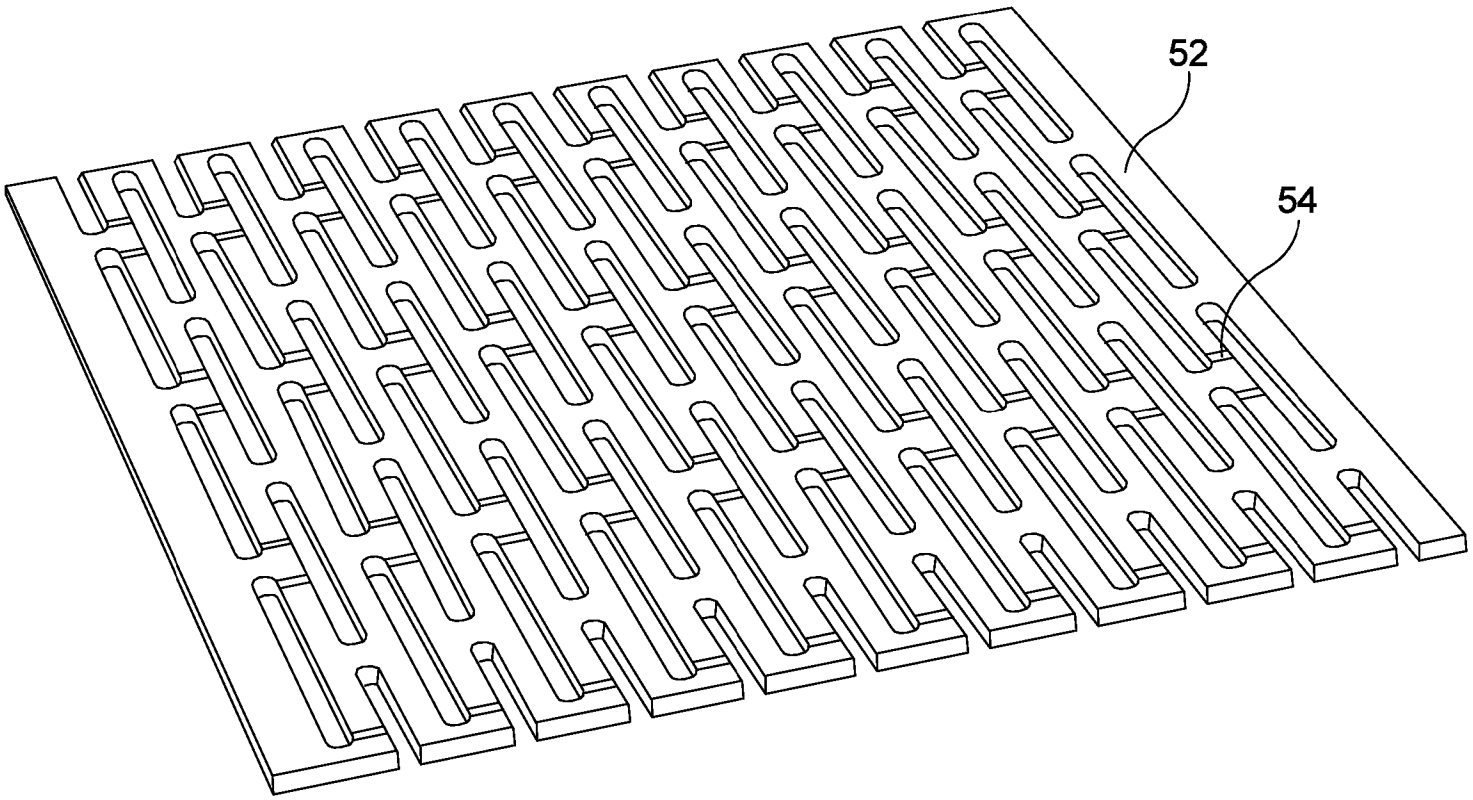

Reference is now made to FIGS. 7 and 8 of the drawings, which are perspective views of perforated sheets 50, 52 utilized to form a filter-cake-disrupting shroud in accordance with further embodiments of the present invention. The sheets 50, 52 are similar to the sheet 30 illustrated in FIG. 4, with the addition of grooves 54 which extend part-way through a number of the webs. The sheets 50, 52 of this embodiment are formed on 1.5 mm thick steel sheet and the grooves 54 are 1.25 mm deep. Of course other materials and other dimensions may be appropriate for other embodiments.

Figure 9:
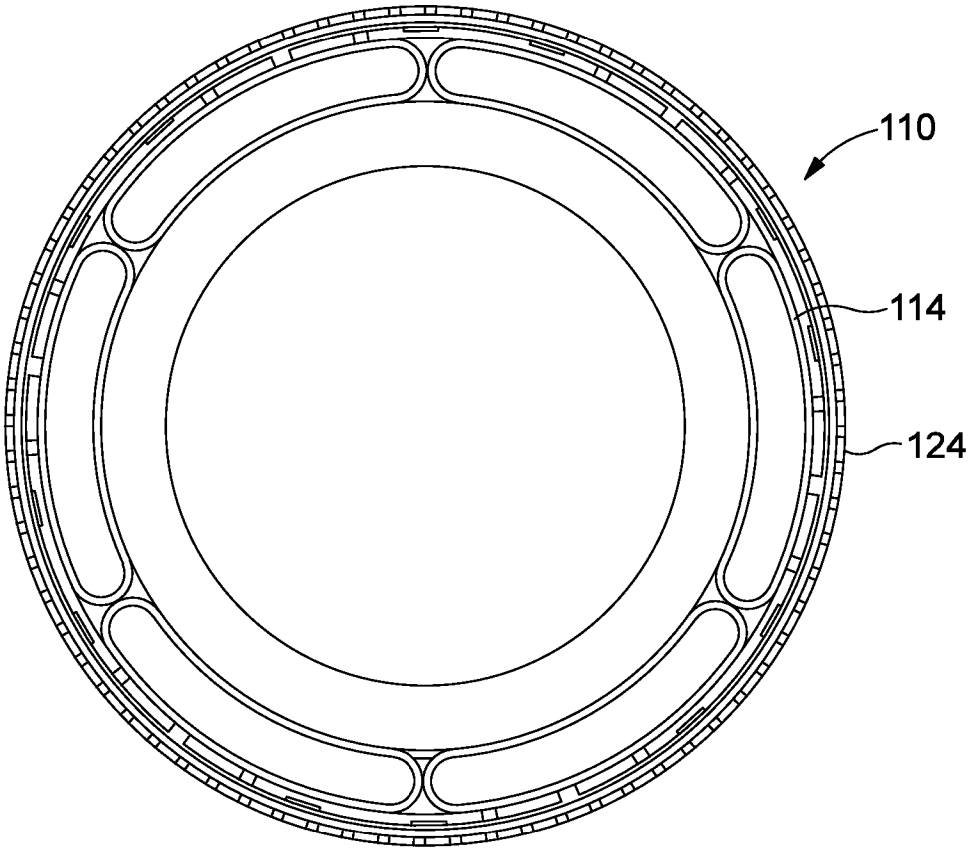
FIGS. 9 and 10 are sectional views of a sand screen incorporating a shroud formed from one of the sheets of FIGS. 7 and 8.
Figure 10:
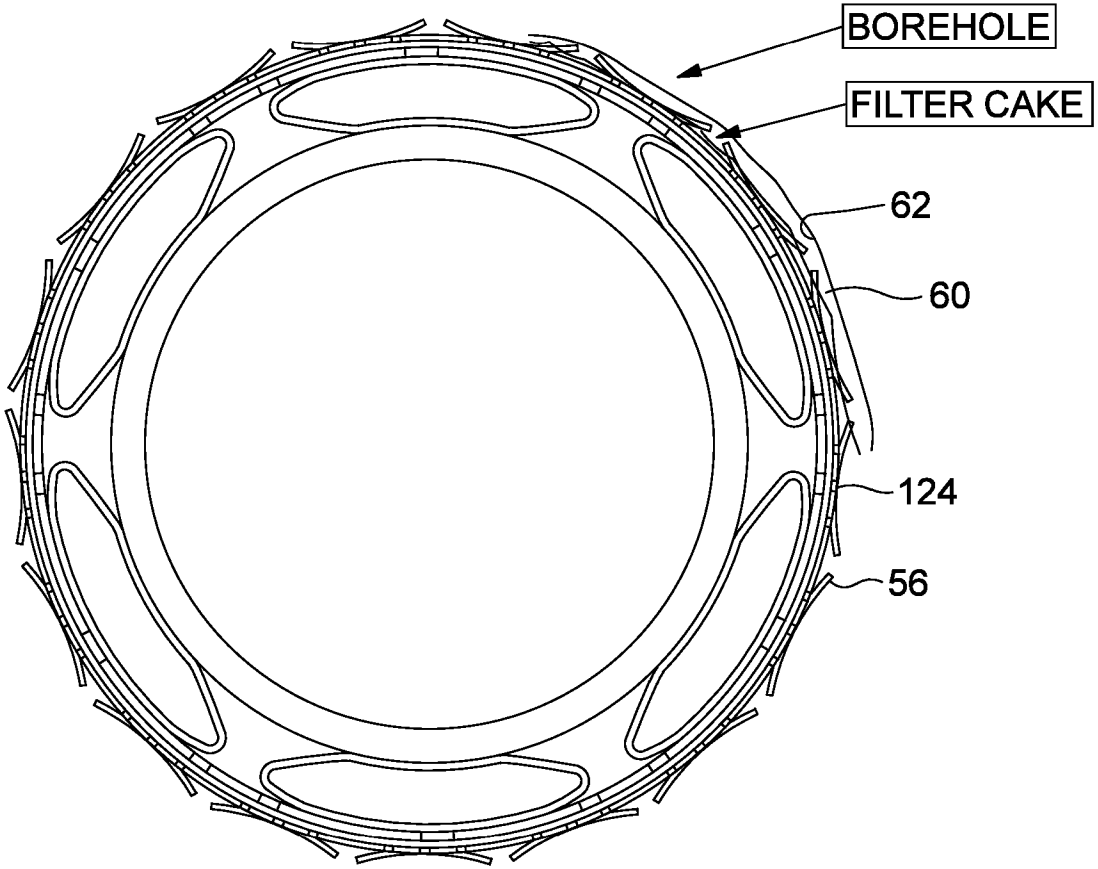

The effect of the grooves 54 may be seen from FIGS. 9 and 10 of the drawings, which are sectional views of a sand screen 110 incorporating a shroud 124 formed from one of the sheets of FIGS. 7 and 8.

On activation of the screen 110, by inflating the chambers 114, the shroud 124 is extended and as this progresses the grooves 54 separate, allowing the resulting free fingers 56 to spring outwards beyond the outer face of the remainder of the shroud 124. The fingers 56 thus penetrate the filter cake 60 covering the borehole wall 62.

Figures 11A, 11B, 11C:
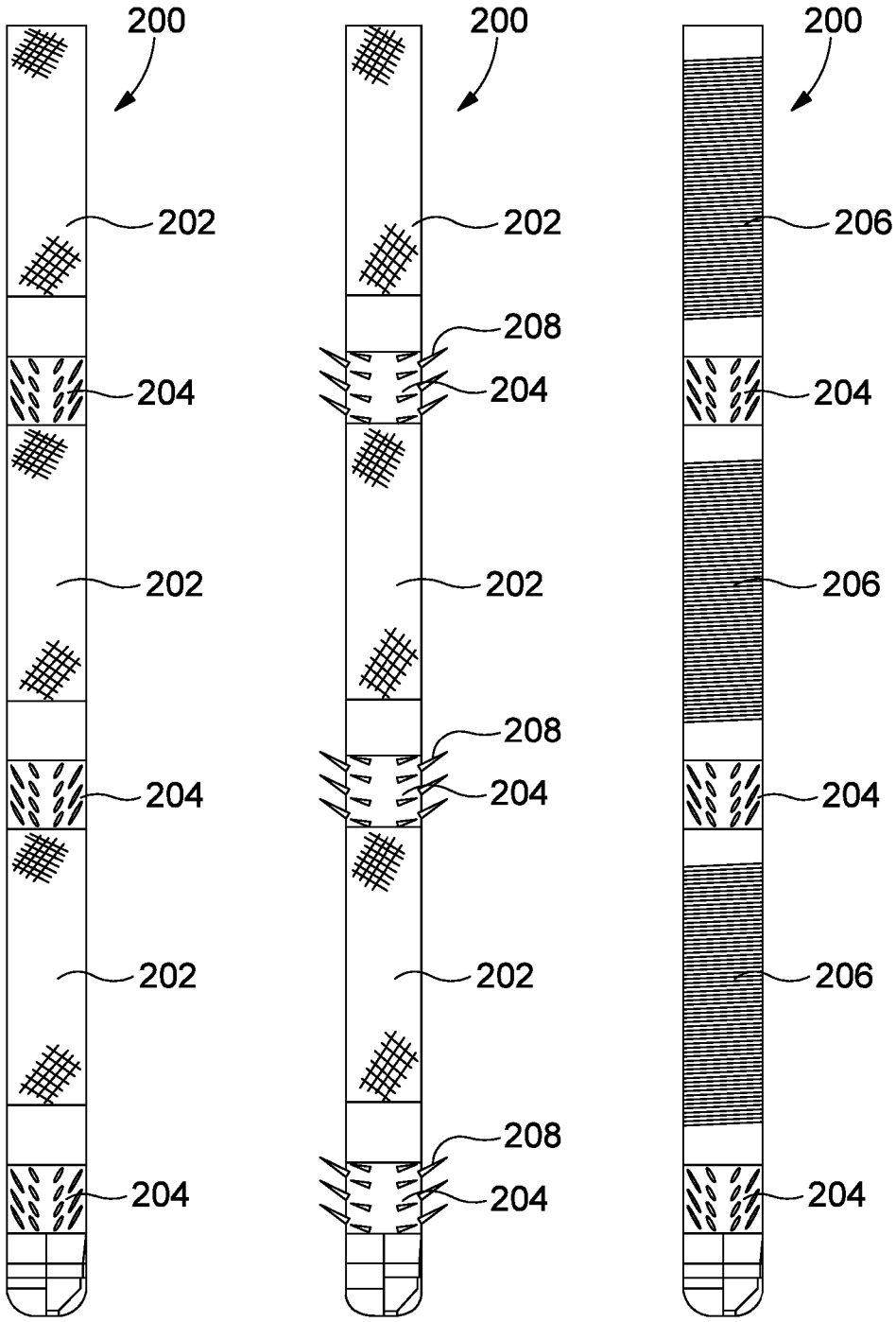
FIGS. 11*a*, 11*b* and 11*c* are schematic views of part of a completion including three screens in accordance with a further embodiment of the present invention.

Reference is now made to FIGS. 11*a* and 11*b*, which are schematic views of a completion 200 including three sand screens 202 and three filter cake-disrupting apparatus 204 positioned alternately with the sand screens 202 in the completion 200. However, any number or distribution of sand screens 202 or disrupting apparatus 204 can be utilized. The apparatus 204 is shown in a retracted configuration in FIG. 11*a* and in an extended configuration in FIG. 11*b*.

The apparatus 204 can be in any appropriate form, such as in the form of the shrouds 24, 124, or the filter cake-disrupting apparatus 300, 400, 500 or 600 described herein. In the retracted configuration the apparatus 204 maintains a generally smooth cylindrical form, or at least be dimensioned to pass through restrictions in a bore or in a reduced diameter section of bore or casing liner. However, in an extended or activated configuration the apparatus 204 includes at least one disrupting member 208 which extends radially outwardly with respect to the apparatus 204.

FIG. 11*c* shows the completion 200 in a similar form to the completion of FIG. 11*a*, but instead having three wire-wrapped screens 206 in place of the sand screens 204. It will be appreciated that a number of different types of screens could be used, for example, gravel pack screens, slotted-liner, and the like. Although several apparatus 204 are shown in the completion 200, there need only be one apparatus 204, or there may be any number of apparatus 204 in any one completion.

It will also be appreciated that a filter cake-disrupting apparatus 204 can also be provided as a stand-alone item on a string or individual sub, for example, without any associated completion elements, or the like.

Figure 12:
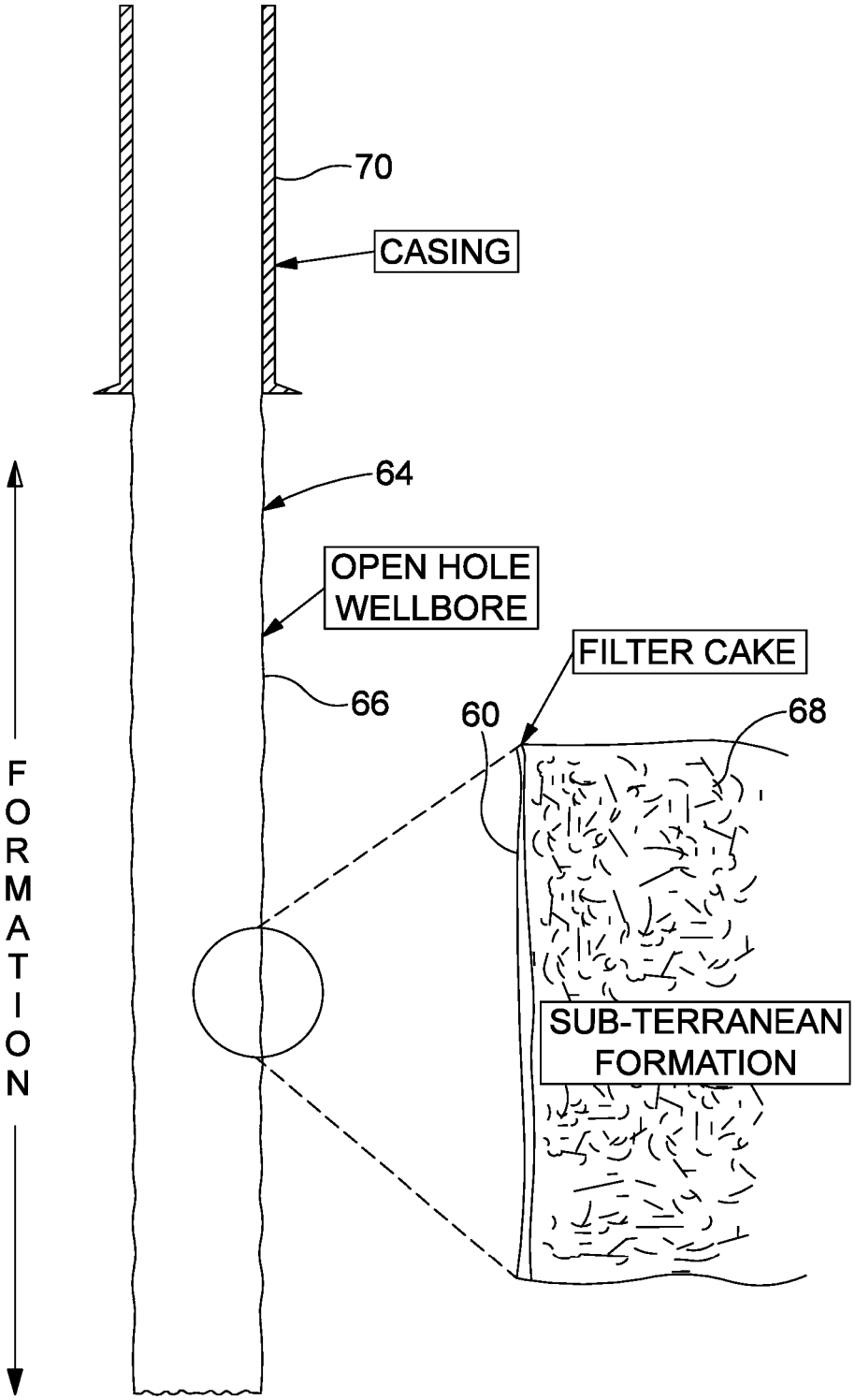
FIG. 12 is a schematic view of a wellbore lined with filter cake.

FIG. 12 is a schematic view of a wellbore 64 which is lined with filter cake 60 in an open hole section 66 of a bore 64, in a formation 68. A section of casing 70 is provided above the open hole section 66.

Figure 13:
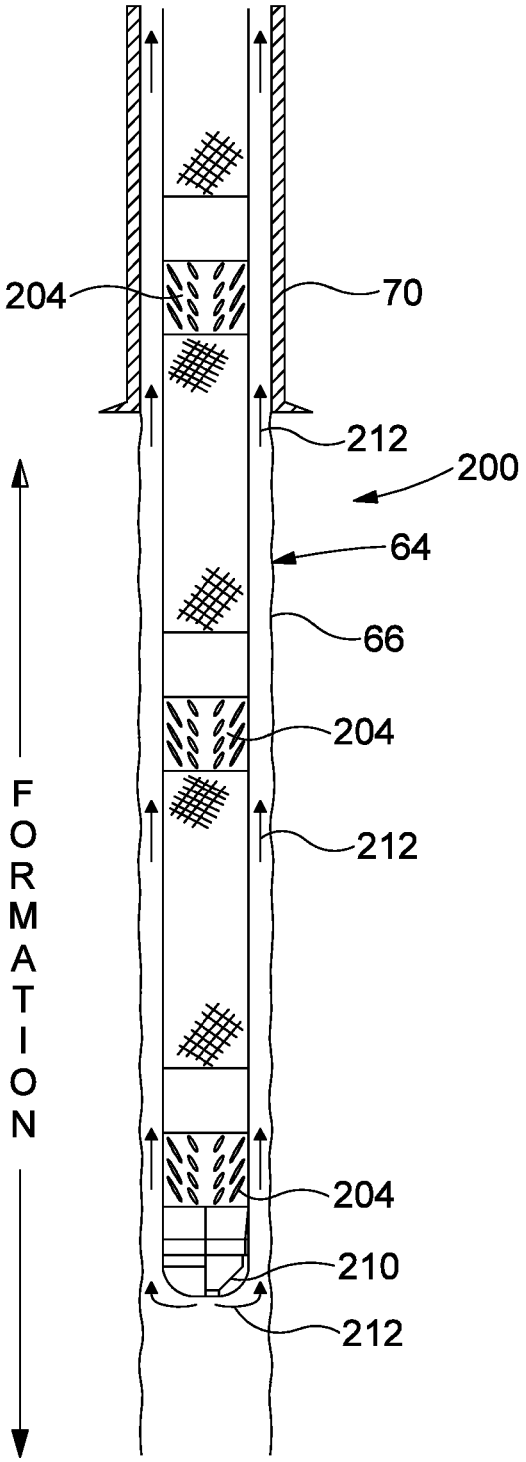
FIG. 13 is a schematic view of the completion shown in FIG. 11*a* which has been deployed in a wellbore.

FIG. 13 shows the completion 200 of FIG. 11*a* disposed in the bore 64 of FIG. 12. The completion 200 is run into the bore 64 with the apparatus 204 in the retracted configuration. Upon the completion 200 reaching a predetermined position in the open hole section 66, the apparatus 204 is activated to assume the extended configuration (as shown in FIG. 11*b*). It will be recognized that the uppermost apparatus 204 in FIG. 13 is situated in a section of casing 70 of the bore 64, and not in the open hole section 66. Therefore, the completion 200 needs to be lowered further into the open hole section 66 before activating the apparatus 204.

Once in the predetermined position, the filter cake-disrupting members 208 extend radially outwardly and penetrate the filter cake 60. Activating the apparatus 204 may alone be sufficient to disrupt or remove the filter cake 60. However, the apparatus 204 may additionally be movable within the bore 64. The apparatus 204 may be moved in a single direction within the bore, for example, in a single axial direction. The apparatus 204 may be reciprocated within the bore, for example, the apparatus 204 may be moved axially back and forth. The apparatus 204 may be rotated within the bore, for example, the apparatus 204 may be rotated in one or both angular directions, or the apparatus 204 may be oscillated in both angular directions. By moving the apparatus 204 within the bore, the filter cake-disrupting member 208 may disrupt or remove filter cake during movement across a section of the bore wall lined with filter cake.

The apparatus 204 may be moved in any combination of different ways. For example, the apparatus 204 may be reciprocated and rotated within the bore in sequence, in separate steps, or simultaneously reciprocated and rotated.

The activation of the apparatus 204 and movement of the disrupting apparatus 204 or member 208 in a filter cake-lined section 60 of the bore may disturb, loosen, peel, scrape, scratch, remove or otherwise disrupt the filter cake.

A circulation guide shoe 210 is also provided for circulating fluid (the direction of fluid flow being indicated by arrows 212) from the bottom end of the completion 200 into the wellbore 64, via the annulus between the completion and the wellbore 64, and up to surface (not shown). The circulating fluid can be in the form of a fluid which assists in disrupting or removing filter cake 60 from the open hole section 66.

The fluid may include any suitable fluid for disrupting or removing filter cake, for example, a scouring fluid, a breaking fluid, or the like.

The fluid may include an abrasive component, for example, the fluid may include an angular sand, or the like. Fluid flow may enhance abrasive action of the fluid, facilitating break-down and removal of filter cake 60 from the bore wall.

The fluid may include a chemical for breaking-down, assisting to break-down, or dissolving the filter cake 60, for example, any one of an acidic fluid, an oxidative solution, a solubilising fluid, an enzyme, and the like.

Although FIG. 13 shows fluid circulation while the apparatus 204 is in the retracted configuration, it will be appreciated that fluid circulation may also occur during and after activation of the apparatus 204. Accordingly, fluid may be circulated while the completion is lowered downhole, or during or after activation of the apparatus 204.

It will be appreciated that fluid may be circulated in the bore 64 by virtue of fluid being pumped into the bore 64. Alternatively, or in addition, fluid flow in to or out of the formation 68 may also result in fluid flow and circulation in the bore 64. A person of skill in the art will appreciate that selection of appropriate downhole conditions will be necessary to ensure the filter cake disruption and removal operation runs safely and efficiently, without uncontrolled fluid flow in to or out of the formation.

Once the filter cake 60 has been at least partially disturbed or removed, the screens 202 may be installed ready for production from the formation 68. The completion 200 could be configured to provide one or more downhole operations during or once the filter cake 60 has been disrupted or removed, for example, an injection operation may be facilitated by the removal of filter cake.

Figure 14:
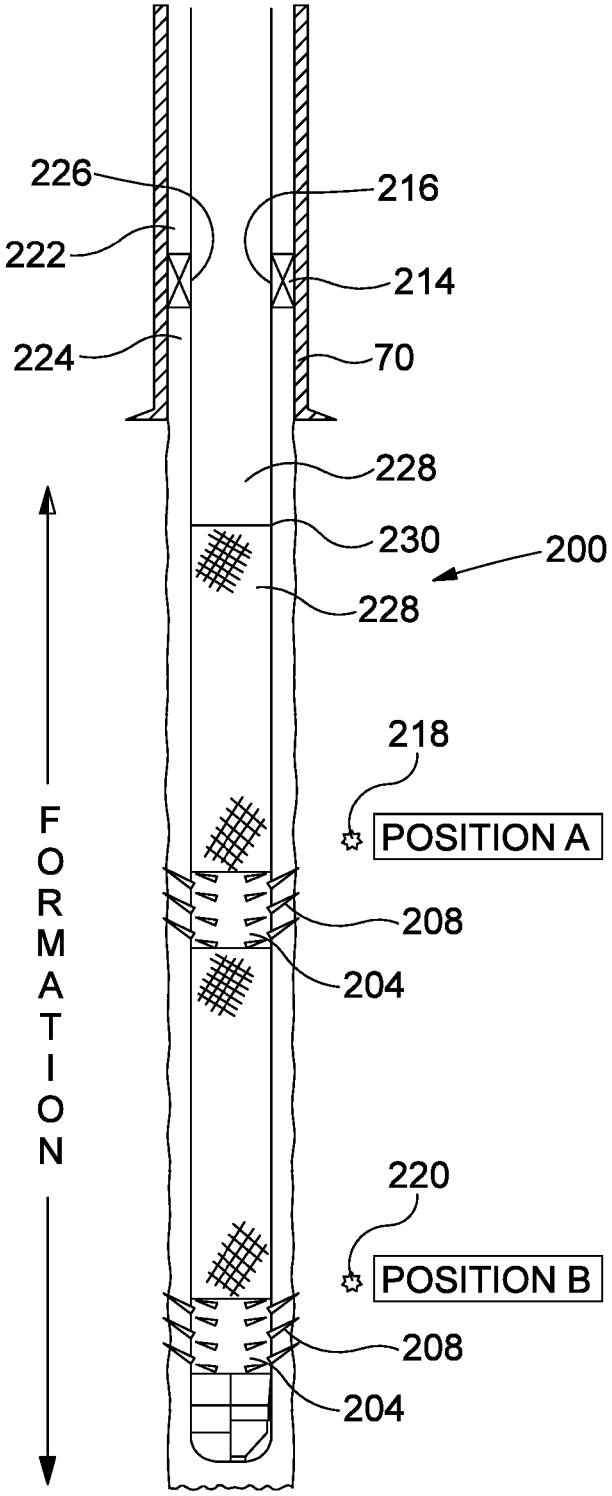
FIG. 14 is a schematic view of a completion shown in FIG. 11*b* in a further configuration.

Referring now to FIG. 14, the completion 200 is shown with two apparatus 200 in the extended or activated configuration, however an upper portion of the completion 200 includes a packer 214 mounted on the completion 200.

The packer 214 includes a bore 216 within which a tubular component of the completion 200 is received. In use, the completion 200 is lowered down the bore 64 with the apparatus 204 in the retracted configuration and the packer 214 is carried downhole by the completion 200. Upon the lower apparatus 204 passing a first axial bore position 218 (indicated by position A), the packer 214 is activated to provide an annular seal in a section of casing 70, thereby restricting or preventing fluid flow from one side of the packer 214 to the other side. The packer 214 therefore serves to prevent or restrict uncontrolled fluid flow between the upper annulus section 222 and the lower annulus section 224, for example, when filter-cake is being disrupted or removed, and the loss of fluids into the formation 68 is more likely. Therefore, in the event of uncontrolled fluid flow in to or out of the formation 68, the packer 214 is used to reduce the impact of uncontrolled fluid flow. The packer 214 prevents or reduces the risk of an uncontrolled fluid flow, such as a kick from the formation. A skilled person would appreciate how best to control downhole conditions in the bore 64 to prevent uncontrolled fluid flow, as well as to provide a suitable packer 214.

The packer 214 includes a seal element 226 in the packer bore 216 to prevent fluid flow between the upper annulus section 222 and lower annulus section 224 via the packer bore 216. When a tubing component 228 is provided in the packer bore 216, the seal element 226 engages the outer surface of the tubing component 228 to provide a seal to prevent or restrict fluid flow.

Once the packer 214 has been set or activated such that the packer 214 is fixed in position in the casing 70. The tubing components 228 are then free to move through the packer 214, without displacing the packer 214. In some embodiments, one or more packers 214 may be set or activated in the open hole section 66 to provide zonal isolation.

Once the packer 214 has been set, or is in the process of being set, the apparatus 204 can be extended or activated, such that the filter cake-disrupting members 208 extend radially outwardly to engage or penetrate the filter cake 60.

The completion 200 is then further lowered until the lower apparatus 204 passes a second axial bore location 220 (indicated by position B). In this manner, filter cake 60 may be disrupted or removed from the bore wall. It will be appreciated that the completion 200 could be moved in any appropriate manner to facilitate filter cake disruption or removal.

It will be recognized that the completion 200 includes several tubular components 228 joined together in order to provide the required length of the completion 200. Each tubular component 228 is joined together at each axial end, as shown by joint 230. In order for the completion to pass through the packer bore 216, the diameter of each tubular component 228 may be identical in order that each tubular component 228 can pass through the packer bore 216. Further, sealing element 226 may provide a seal when the joint 230 passes through the packer bore 216. Therefore, the joint 230 may be configured to cooperate with the sealing element 226 to provide a seal sufficient to prevent fluid flow between the upper annulus section 222 and the lower annulus section 224. As will be recognized from FIG. 14, the tubular components 228 have an outer surface which is substantially flush with respect to each other.

The tubing components 228 may also be movable in any manner within the packer bore 216, for example, axially or rotationally movable. However, the seal element 226 may still provide a seal during movement of the tubing components 228 within the packer bore 216. In this manner, the completion 200 can be manipulated to perform various downhole operations, including filter cake removal operations, and positioning completion tools at required bore locations.

The packer 214 includes a fluid flow diverter or valve (not shown). The diverter or valve may allow fluid to be flowed or circulated in the bore, for example, fluid may be circulated to surface. It will be appreciated that any appropriate diverter or valve could be provided. The packer 214 prevents fluid in the upper annulus 222 from moving into the lower open hole section 66. Therefore, fluid and material (such as completion fluid or mud) in the upper annulus 222 is prevented or restricted from entering the open hole section 66. However, wellbore fluid containing fluid for disrupting or removing filter cake, as well as portions of filter cake 60, and the like, may be circulated through the diverter or valve, and into the upper annulus 222, and out to the surface for appropriate disposal. It will be appreciated that any appropriate fluid flow arrangement may be implemented by the person of skill in the art.

As described above, the apparatus 200 may take a number of different forms.

Figure 15A:
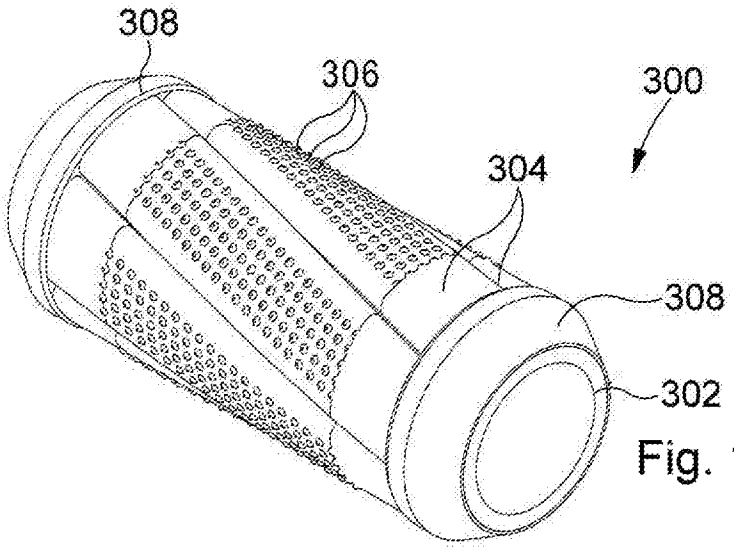
FIG. 15*a* is a view of a filter cake-disrupting apparatus in accordance with an embodiment of the present invention.
Figure 15B:
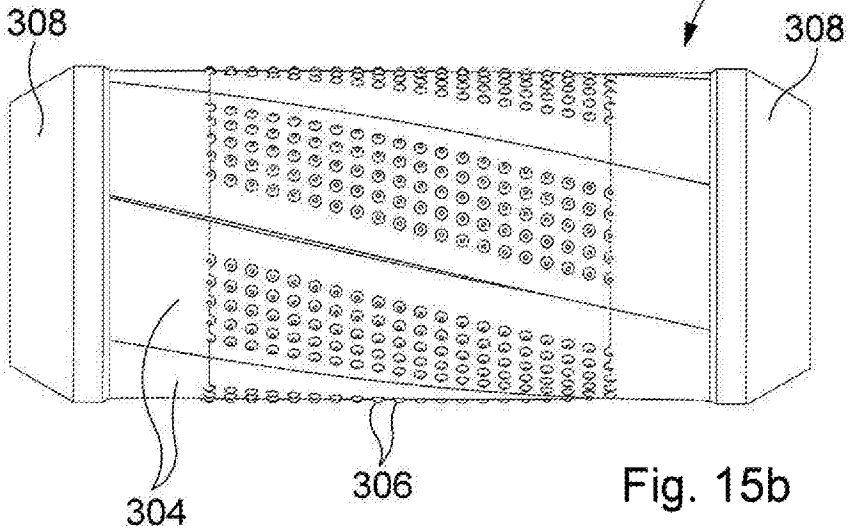
FIG. 15*b* is a side view of the filter cake-disrupting apparatus of FIG. 15*a;*
Figure 15C:
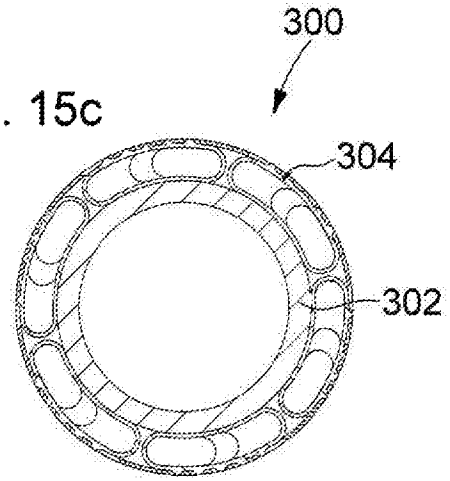
FIG. 15*c* is a sectional view of the filter cake-disrupting apparatus of FIG. 15*a;*
Figure 15D:
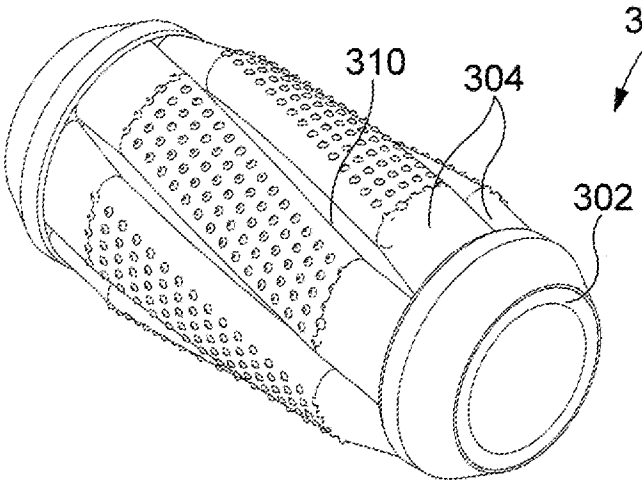
FIG. 15*d* is a view of the filter cake-disrupting apparatus of FIG. 15*a*, wherein the apparatus is in an activated configuration.
Figure 15E:
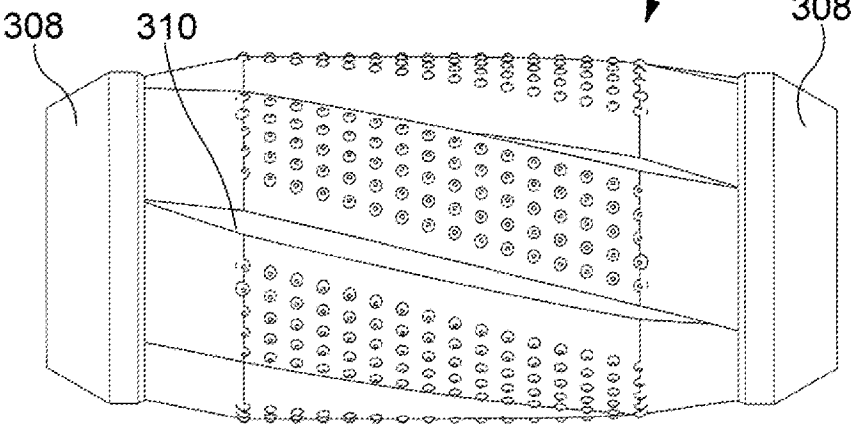
FIG. 15*e* is a side view of the filter cake-disrupting apparatus of FIG. 15*d;*
Figure 15F:
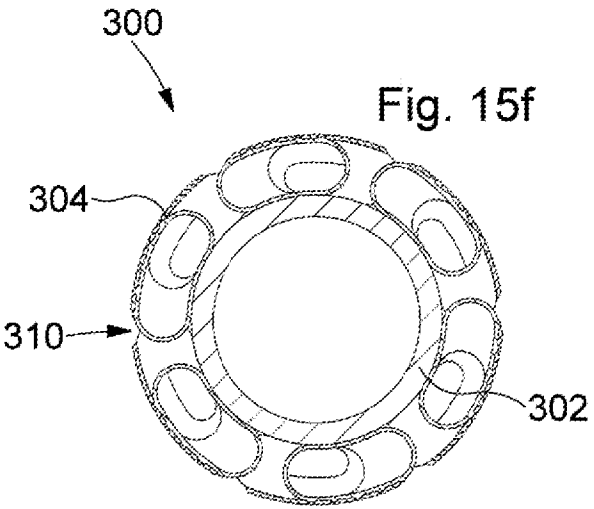
FIG. 15*f* is a sectional view of the filter cake-disrupting apparatus of FIG. 15*d;*

Reference is now made to FIGS. 15*a*-15*f*, which show a filter cake-disrupting apparatus 300 which may be connected to and operable from surface via a string or the like (not shown). FIGS. 15*a*-15*c* show the apparatus 300 in a retracted configuration and FIGS. 15*d*-15*f* show the apparatus 300 in an extended or activated configuration. Disrupting apparatus 300 is similar in form to the screen apparatus in FIGS. 2-3 and 9-10. However, in the present embodiment, no drainage layer, weave or shroud is present. However, it would be understood that any of these features could be incorporated into the present embodiment.

Disrupting apparatus 300 includes a base pipe 302 and six filter cake-disrupting chambers 304 which are mounted on the outer surface of the base pipe 302. Each chamber 304 extends helically along the outer surface of the base pipe 302. The disrupting chambers 304 are arranged adjacent to each other around the circumference of the base pipe 302 such that the disrupting members 304 substantially surround the outer surface of the base pipe 302. The disrupting chambers 304 each include an array of filter cake-engaging elements 306 spaced apart on the outermost circumferential surface of the chambers 304. Each engaging element 306 is a protrusion shaped in the form of a cone pointing radially outwardly with respect to the base pipe 302. However any appropriate shape or distribution of elements 306 may be used. The apparatus 300 includes a cap 308 provided at each axial end of the base pipe 302 to maintain the chambers 304 in place.

The filter cake-disrupting chambers 304 may be inflated or deformed by filling the chambers 304 with high pressure fluid such that the chambers 304 assume an activated configuration, as illustrated by FIGS. 15*d*-15*f*. Upon activation, the chambers 304 are expanded such that the engaging elements 306 are extended radially outwardly with respect to the base pipe 302.

As shown in FIGS. 15*d*-15*f*, once activated, not only do the chambers 304 expand radially outwardly, but the chambers also contract inwardly such that the circumferential extent of the chambers 304 is contracted. In this manner, gaps 310 open up between adjacent chambers 304. However, since the chambers 304 are arranged helically around the base pipe 302, engaging elements 306 still provide circumferential coverage around the outer surface of the apparatus 300 such that filter cake can be disrupted around the circumferential inner surface of the filter cake-lined bore wall.

In use, the apparatus 300 is initially provided in the retracted configuration of FIGS. 15*a*-15*f*, then run downhole to a filter cake-lined section of a bore (see FIG. 12 for an example of such a bore). The chambers 304 are then activated to assume the extended or activated configuration. As the engaging elements 306 are extended radially outwardly, the elements may contact or protrude into the filter cake on the bore wall. This may in itself be sufficient to disrupt the filter cake, however a force may be applied (for example, via a string, weight, or by internal pressure) on the apparatus 300 to move the apparatus 300 relative to the bore wall. The apparatus 300 may be moved in any direction, for example axially or circumferentially, such that as the engaging elements 306 move along the filter cake-lined section, the engaging elements 306 disturb, loosen, peel, scrape, scratch, remove or otherwise disrupt the filter cake. Disrupted or removed filter cake can then be transported, for example via fluid flow, to another section of the bore, or to surface, or the like.

Figure 16B:
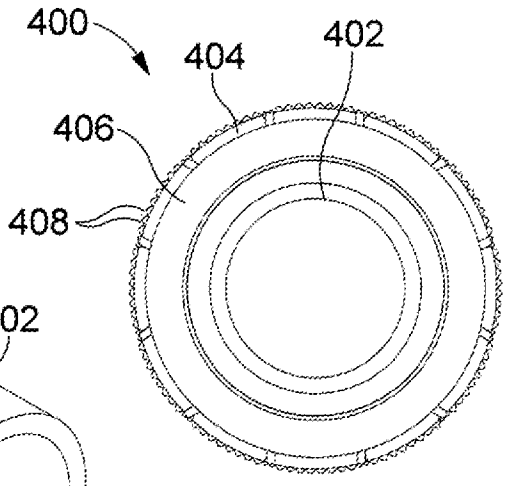
FIG. 16*b* is a section view of the filter cake-disrupting apparatus of FIG. 16*a;*
Figure 16A:
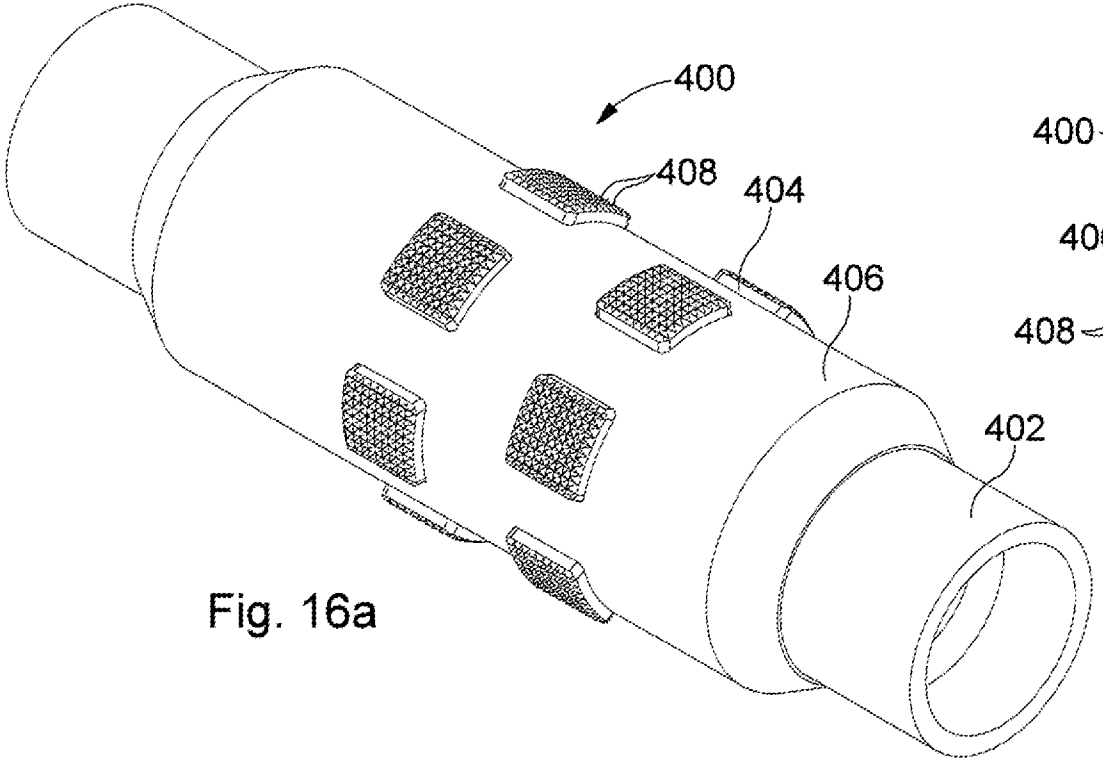
FIG. 16*a* is a view of a filter cake-disrupting apparatus in accordance with an embodiment of the present invention.
Figure 16C:
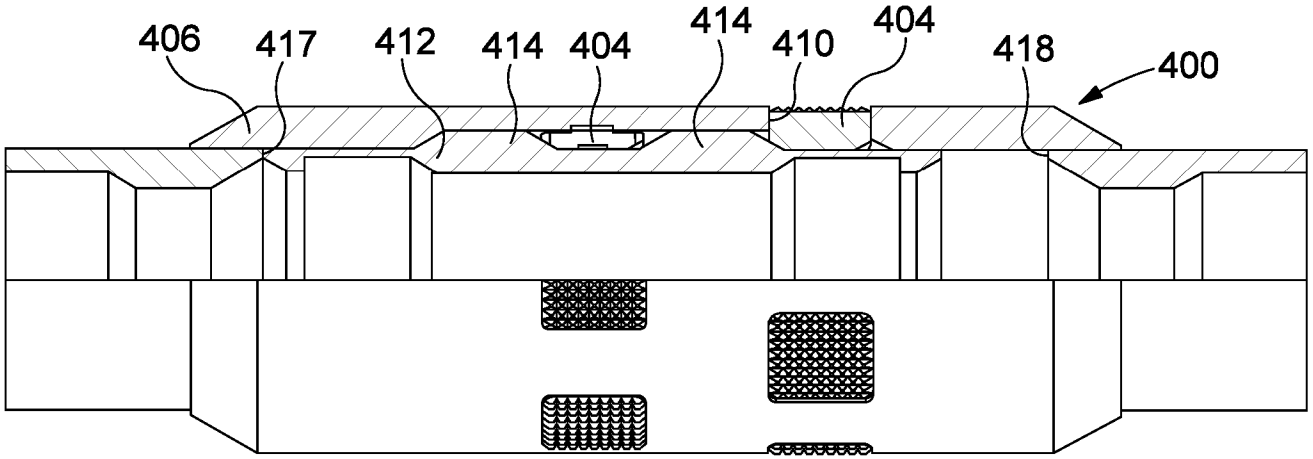
FIG. 16*c* is a part-sectional view of the filter cake-disrupting apparatus of FIG. 16*a;*
Figure 16D:
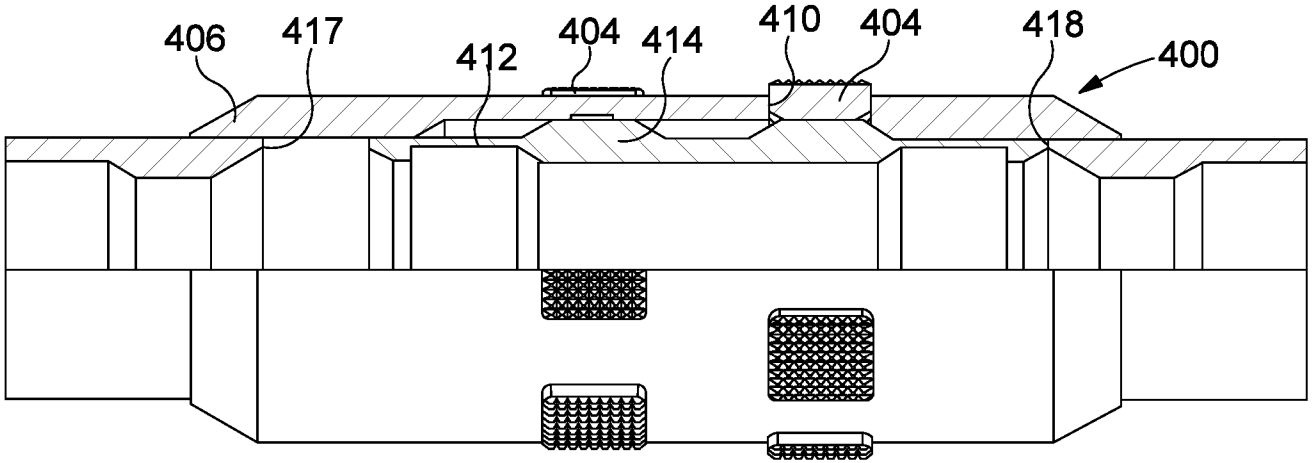
FIG. 16*d* is a part-sectional view of the filter cake-disrupting apparatus of FIG. 16*a*, wherein the apparatus is in an activated configuration.

Reference is now made to FIGS. 16*a*-16*d*, which show a filter cake-disrupting apparatus 400 which may be connected to and operable from surface via a string or the like (not shown). FIGS. 16*a*, 16*b* and 16*d* show the apparatus 400 in an extended or activated configuration. FIG. 16*c* show the apparatus 400 in a retracted configuration.

Disrupting apparatus 400 includes a base pipe 402 and twelve filter cake-disrupting dogs 404 which are mounted on the outer surface of a housing 406. The disrupting dogs 404 include an array of filter cake-engaging elements 408 protruding radially outwardly of the outermost circumferential edge of disrupting dogs 404. Each engaging element 408 is a protrusion shaped in the form of a pyramid pointing radially outwardly with respect to the base pipe 402, and each element 408 is closely packed with the other elements 408 on the same dog 404. However, any appropriate shape or distribution of engaging elements 408 may be used.

The dogs 404 are distributed around the outer surface of the housing 406 such that a first set of six dogs 404 are equally spaced apart circumferentially around the housing 406. A second set of six dogs 404 are also equally spaced apart circumferentially around the housing 406, but offset circumferentially and axially with respect to the first set of dogs 404 such that collectively, the first and second set of dogs 404 provide circumferential filter cake-disrupting coverage around the outer surface of the apparatus 400, as best illustrated by FIG. 16*b*.

Referring to FIGS. 16*c* and 16*d*, the dogs 404 are movably coupled to apertures 410 provided in the housing 406. When the apparatus 400 is provided in the retracted configuration, the dogs 404 are retained in the apertures 410 such that the engaging elements 408 of the dogs 404 do not protrude radially outwardly with respect to the outer surface of the housing 406. When the apparatus 400 is provided in the extended or activated configuration, the dogs 404 are moved radially outwardly of the apertures 410 such that the dogs 404 protrude radially outwardly with respect to the outer surface of the housing 406.

The housing 406 includes a sleeve 412 which is slidably movable in an axial direction within the housing 406. The sleeve 412 includes support elements 414 which extend radially outwardly with respect to the sleeve 412. A longitudinally-extending recess 416 is provided between the outer surface of the sleeve 412 and the inner surface of the housing 406 within which the support elements 414 are accommodated. The accommodation provided by the longitudinally-extending recess 416 allows the support elements 414 to move axially within the recess 416 when the sleeve 412 is axially moved with respect to the housing 406.

When the apparatus 400 is in the retracted configuration, the dogs 404 are also partially accommodated within the recess 416 because the apertures 410 in the housing 406 connect with the recess 416, allowing the dogs 404 to contact and sit on the sleeve 412. In use, the sleeve 412 is moved from a first axial position (see FIG. 16*c*) in which the sleeve 412 abuts a first shoulder 417 at an end of the housing 406 to a second axial position (see FIG. 16*d*) in which the sleeve 412 abuts a second shoulder 418 at the opposite end of the housing 406. As the sleeve moves from the first axial position to the second axial position, the support elements 414, which feature tapered edges, move axially within the recess to engage and lift the dogs 404 radially outwardly with respect to the housing 406.

The sleeve 412 may be moved mechanically, by fluid pressure, or by any other appropriate means. The sleeve 412 may include a locking mechanism (not shown) in order to retain the sleeve in the first axial position until required, or to retain the sleeve in the second axial position so that the dogs 404 remain extending radially outwardly with respect to the housing 406. The dogs may include a retaining mechanism (not shown) to ensure that the dogs 404 do not pop out of the apertures 410. It will be apparent to the person of skill in the art how to move the sleeve 412 with respect to the housing 406, and also how to provide locking and retaining features as described herein.

The apparatus 400 may be used to disrupt filter cake in any appropriate manner, for example, as described in relation to the apparatus 300, or indeed any of the other embodiments described herein.

Figure 17A:
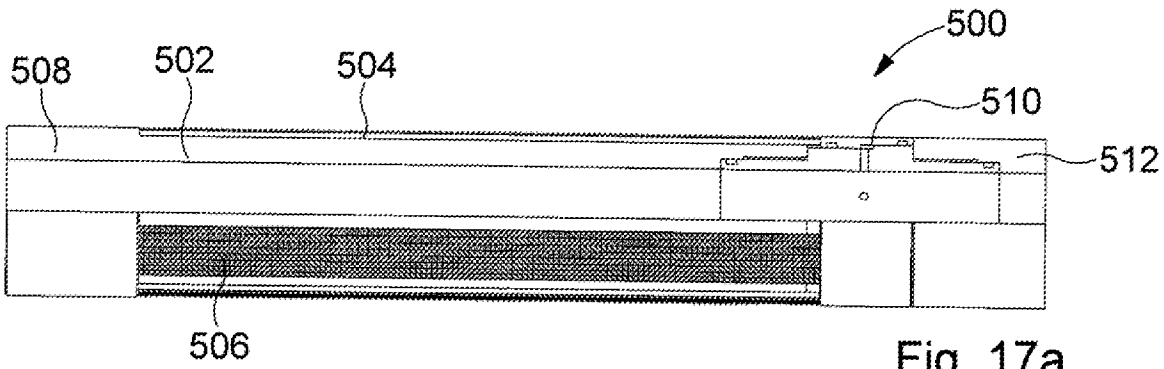
FIG. 17*a* is a part-sectional view of a filter cake-disrupting apparatus in accordance with an embodiment of the present invention
Figure 17B:
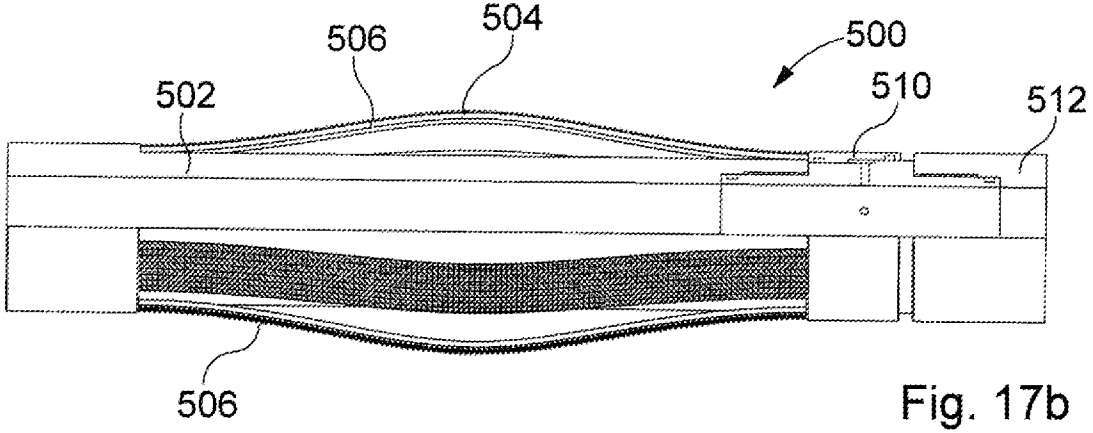
FIG. 17*b* is a part-sectional view of the filter cake-disrupting apparatus of FIG. 17*a*, wherein the apparatus is in an activated configuration.
Figure 17F:
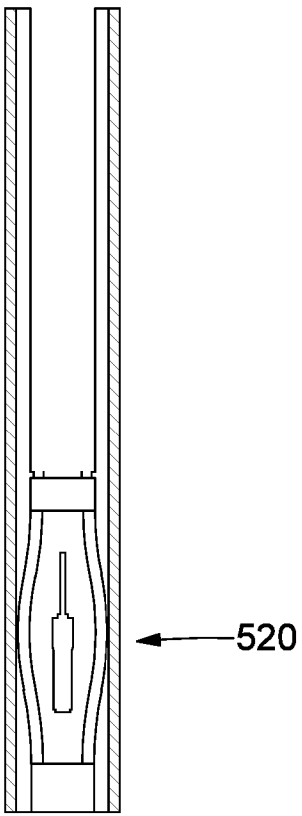
FIGS. 17*d*-17*f* are schematic views of the filter cake-disrupting apparatus of FIG. 17*b* as the apparatus progresses in a filter cake-lined section of a bore.
Figure 17E:
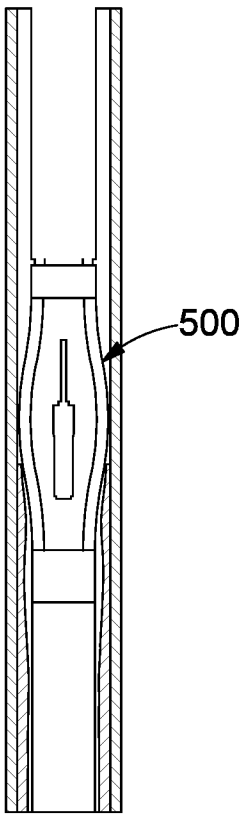
Figure 17D:
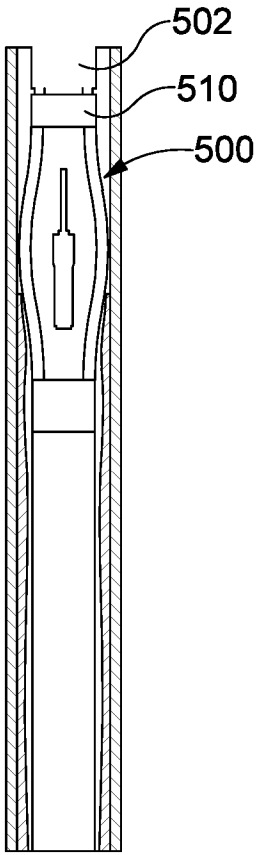
Figure 17C:
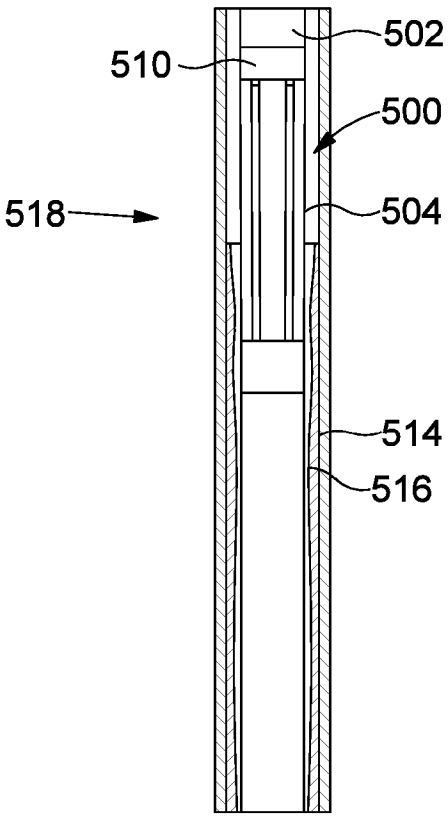
FIG. 17*c* is a schematic view of the filter cake-disrupting apparatus of FIG. 17*a* in a filter cake-lined section of a bore.

Reference is now made to FIGS. 17*a*-17*f*, which show a filter cake-disrupting apparatus 500 which may be connected to and operable from surface via a string or the like (not shown). FIGS. 17*a* and 17*c* show the apparatus 500 in a retracted configuration. FIGS. 17*b*, 17*d*-17*f* show the apparatus 500 in an extended or activated configuration.

Disrupting apparatus 500 includes a tubular 502 and a set of filter cake-disrupting bows 504 which are mounted on, and extend longitudinally along, the outer surface of the tubular 502. The disrupting bows 504 include an array of filter cake-engaging elements 506 protruding radially outwardly of the outermost circumferential edge of disrupting bows 504. Each engaging element 506 is a protrusion shaped in the form of a pyramid pointing radially outwardly with respect to the tubular 502, and each element 506 is closely packed with the other elements 506 on the same bow 504. However, any appropriate shape or distribution of engaging elements 506 may be used.

The bows 504 are distributed side-by-side around the outer surface of the tubular 502 such that the bows 504 provide part-circumferential filter cake-disrupting coverage around the outer surface of the apparatus 500.

The bows 504 are mounted between a first cap 508 at a first end of the tubular 502, and a piston 510 at an opposite end of the tubular 502. In the retracted configuration, the piston 510 abuts a second cap 512 at a second, opposite end of the tubular 502. In use, when moving into the extended or activated configuration, the piston 510 moves axially along the tubular away from the second cap 512. As the bows 504 are axially compressed by movement of the piston 510 towards the first cap 508, the bows 504 deform or flex such that a portion of the bows 504 extend radially outwardly with respect to the tubular 502. As illustrated by FIG. 17*b*, a central portion of the bows 504 bends radially outwardly from the tubular 502.

The piston 510 may be moved mechanically, by fluid pressure, or by any other appropriate means. The piston 510 may include a locking mechanism (not shown) in order to retain the apparatus 500 in the retracted configuration until required, or to lock the apparatus 500 in the extended or activated configuration. It will be apparent to the person of skill in the art how to move the piston 510 with respect to the tubular 502, and also how to provide locking and retaining features as described herein.

As shown in FIGS. 17*c*-17*f*, the apparatus 500 may be used to disrupt a bore wall 514 lined with filter cake 516. In FIG. 17*c*, the apparatus 500 is provided in the retracted configuration at a first bore location 518. As shown in FIG. 17*d*, the apparatus 500 is then activated to radially extend the bows 504 outwardly with respect to the tubular 502. The apparatus 500 is then progressed downhole to a second bore location 520. During movement of the apparatus 500, the filter cake-engaging elements 506 may disturb, loosen, peel, scrape, scratch, remove or otherwise disrupt the filter cake 516 as the engaging elements 506 contact or penetrate the filter cake 516. Disrupted or removed filter cake can then be transported, for example via fluid flow, to another section of the bore, or to surface, or the like.

The apparatus 500 may be used to disrupt filter cake in any appropriate manner, for example, as described in relation to the apparatus 300, or indeed any of the other embodiments described herein. It will however be noted that the apparatus 500 does not provide fully-circumferential filter cake-disrupting coverage. Therefore, in order to disrupt or remove filter cake from the bore wall 514, the apparatus 500 may need to be rotated in order for the filter cake-engaging elements 506 to contact the full-circumferential surface of the bore wall 514 during rotation. It will also be recognized that the bows 504 may be elastically or plastically deformable, or the bows 504 may include elements (not shown) which enable the bows 504 to be flexed. The bows 504 may be responsive to restrictions in the bore so that as the bows 504 move along the bore wall, the bows 504 may react to the restrictions by deforming or flexing as the bows 504 pass by the restriction.

It will be apparent to those of skill in the art that the apparatus 500 may be configured in a number of different ways. For example, the apparatus 500 may include helically mounted bows which provide fully-circumferential filter cake-disrupting coverage. Alternatively, or in addition, the apparatus 500 may be mounted offset with a secondary apparatus. For example, at least one further apparatus 500 may be provided in a completion, the further apparatus 500 having bows 504 which are provided at a different rotational orientation to the bows 504 of the apparatus 500 such that there is a bow 504 provided for the entire circumference of the bore wall 514. In this manner, the apparatus 500 and further apparatus 500 need not be rotated to effect fully-circumferential filter cake disruption or removal during movement of the apparatus 500 through or within the bore.

Figure 18A:
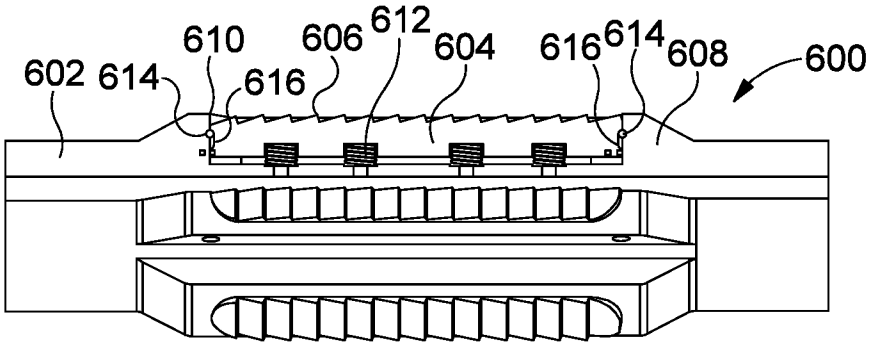
FIG. 18*a* is a part-sectional view of a filter cake-disrupting apparatus in accordance with an embodiment of the present invention
Figure 18B:
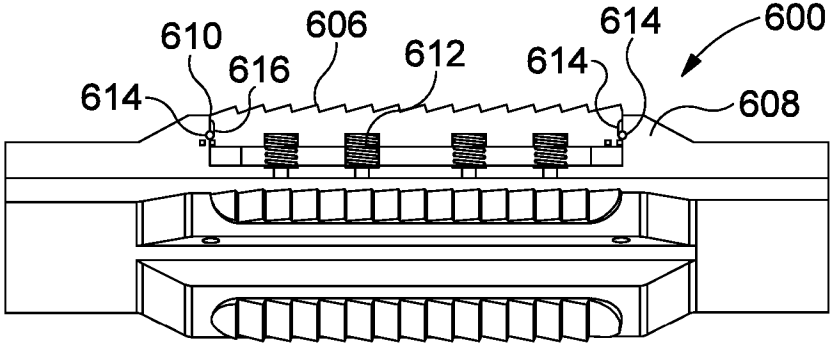
FIG. 18*b* is a part-sectional view of the filter cake-disrupting apparatus of FIG. 18*a*, wherein the apparatus is in an activated configuration.
Figure 18F:
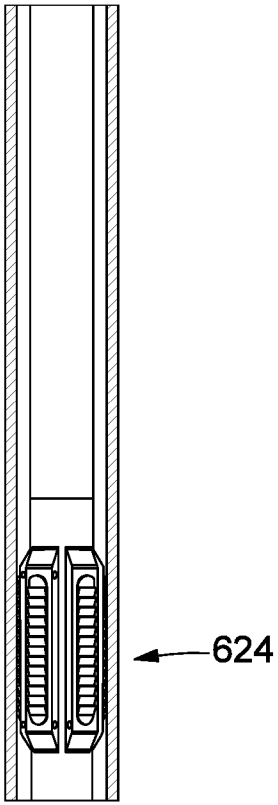
FIGS. 18*d*-18*f* are schematic views of the filter cake-disrupting apparatus of FIG. 18*b* as the apparatus progresses in a filter cake-lined section of a bore.
Figure 18E:
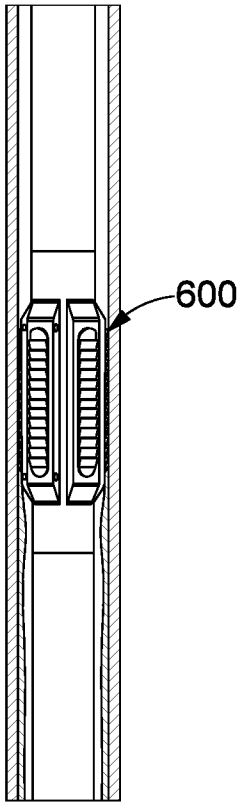
Figure 18D:
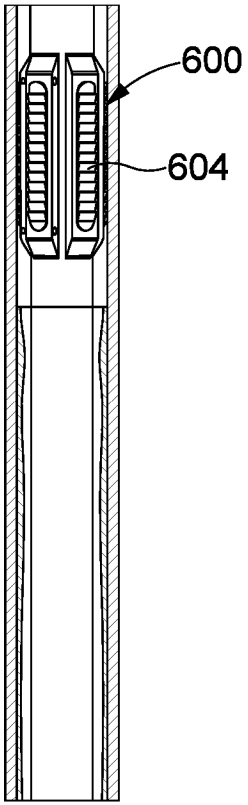
Figure 18C:
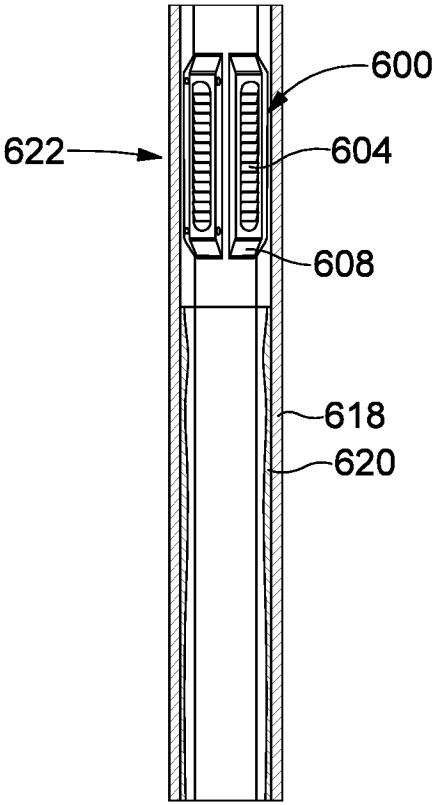
FIG. 18*c* is a schematic view of the filter cake-disrupting apparatus of FIG. 18*a* in a filter cake-lined section of a bore.

Reference is now made to FIGS. 18*a*-18*f*, which show a filter cake-disrupting apparatus 600 which may be connected to and operable from surface via a string or the like (not shown). FIGS. 18*a* and 18*c* show the apparatus 600 in a retracted configuration. FIGS. 18*b*, 18*d*-18*f* show the apparatus 600 in an extended or activated configuration.

Disrupting apparatus 600 includes a tubular 602 and a set of filter cake-disrupting slips 604 which are coupled to, and extend longitudinally along, the outer surface of the tubular 602. The disrupting slips 604 include an array of filter cake-engaging elements 606 protruding radially outwardly of the outermost circumferential edge of disrupting slips 604. Each engaging element 606 is a protrusion shaped in the form of a wedge or tooth pointing radially and axially outwardly with respect to the tubular 602, and each element 606 is organised with respect to the other elements 606 on the same slip 604 such that the slip 604 defines a saw-tooth profile. However, any appropriate shape or distribution of engaging elements 606 may be used.

The slips 604 are arranged side-by-side around the outer surface of the tubular 602 such that the slips 604 provide part-circumferential filter cake-disrupting coverage around the outer surface of the apparatus 600. The tubular 602 includes longitudinally and radially extending ribs 608. Each rib 608 includes an aperture 610, and a slip 604 is mounted within and movably coupled to each aperture 610.

The slips 604 are locked in place with a retaining mechanism (not shown) when the apparatus 600 is in the retracted configuration such that the slips 604 and the engaging elements 606 do not radially extend beyond the radial extent of the ribs 608. However, when the slips 604 are unlocked by the retaining mechanism, the slips 604 are urged radially outwardly by coil springs 612 such that the engaging elements 606 radially extend beyond the radial extent of the ribs 608. Once urged radially outwardly, the slips 604 are locked in place by a locking mechanism (not shown) to provide the apparatus 600 in the extended or activated configuration. Each aperture 608 includes a guide member 614 provided on each end of the aperture 608. The guide members 614 cooperate with a radially extending recesses 616 provided at corresponding ends of each slip 604. In use, as the slips 604 extend radially outwardly, the recesses 616 are guided by the corresponding guide members 614 until the guide member 614 prevents further radial outward movement of the slip 604.

As shown in FIGS. 18*c*-18*f*, the apparatus 600 may be used to disrupt a bore wall 618 lined with filter cake 620. In FIG. 18*c*, the apparatus 600 is provided in the retracted configuration at a first bore location 622. As shown in FIG. 18*d*, the apparatus 600 is then activated to radially extend the slips 604 outwardly with respect to the tubular 602. The apparatus 600 is then progressed downhole to a second bore location 624. During movement of the apparatus 600, the filter cake-engaging elements 606 may disturb, loosen, peel, scrape, scratch, remove or otherwise disrupt the filter cake 620 as the engaging elements 606 contact or penetrate the filter cake 620. Disrupted or removed filter cake can then be transported, for example via fluid flow, to another section of the bore, or to surface, or the like.

The apparatus 600 may be used to disrupt filter cake in any appropriate manner, for example, as described in relation to the apparatus 300, or indeed any of the other embodiments described herein. It will however be noted that the apparatus 600 does not provide fully-circumferential filter cake-disrupting coverage. Therefore, in order to disrupt or remove filter cake from the bore wall 618, the apparatus 600 may need to be rotated in order for the filter cake-engaging elements 506 to contact the full-circumferential surface of the bore wall 514 during rotation.

It will be apparent to those of skill in the art that the apparatus 600 may be configured in a number of different ways. For example, the apparatus 600 may include helically mounted filter cake disruption elements which provide fully-circumferential filter cake-disrupting coverage. Alternatively, or in addition, the apparatus 600 may be mounted offset with a secondary apparatus. For example, at least one further apparatus 600 may be provided in a completion, the further apparatus 600 having disrupting elements 606 which are provided at a different rotational orientation to the disrupting elements 606 of the apparatus 600 such that there is a disrupting element 606 provided for the entire circumference of the bore wall 618. In this manner, the apparatus 600 and further apparatus 600 need not be rotated to effect fully-circumferential filter cake disruption or removal during movement of the apparatus 600 through or within the bore.

It will be apparent to those of skill in the art that any of the apparatus described herein which include filter cake-disrupting elements or members which do not provide fully-circumferential filter cake-disrupting coverage within the bore may be associated with or accompanied by at least one secondary apparatus which provides filter cake-disrupting coverage for any remaining portion of the bore wall lined with filter cake which is not disrupted by at least one of the apparatus. For example, the secondary apparatus may be provided at a different rotational orientation to a first apparatus so that a part of the bore wall not covered by the first apparatus is subject to filter cake disruption or removal by the secondary apparatus.

It will also be apparent to those of skill in the art that any of the apparatus described herein may be provided with or in associated with any other apparatus described herein. For example, a combination of different apparatus described herein may be provided to facilitate filter cake disruption or removal across the full circumferential inner surface of the bore.

It will also be appreciated that different apparatus may be suitable for different filter cake compositions or different downhole environments. Therefore, providing an apparatus or combination of different apparatus as described herein, may provide enhanced filter cake disruption or removal for given filter cake compositions or different downhole environments.

As described above, the illustrated embodiments include structure similar to that described in applicant's earlier GB 2492193 A. However, it will be apparent to those of skill in the art that other arrangements may be utilized. For example, the number of chambers 14 and support strips 18 may be varied, or the sheet may be mounted on a completely different structure or arrangement, for example an otherwise conventional sandscreen, or may be provided on a dedicated sub configured to activate the sheet when desired.

It will also be apparent to those of skill in the art that alternatively or in addition, the completion 200 may be equipped with an injection tool to carry out an injection operation on the formation, the operation being facilitated by previous removal of the filter cake 60 by the apparatus 204 and action of circulating fluid.

It will also be apparent to those of skill in the art that any appropriate packer arrangement could be used. For example, only one packer 214 is shown in FIG. 14, however a plurality of packers could be provided axially spaced apart from each other in the upper annulus 222 to provide a seal between the upper annulus 222 and the open hole section 66.

It will also be apparent to those of skill in the art that features of any embodiment described herein may be combined with any of the features from any other the other embodiments described herein.

The invention claimed is:

1. A downhole apparatus comprising:

a tubular comprising a base pipe and a plurality of inflatable chambers mounted thereon, the tubular having a retracted configuration when the inflatable chambers are in an initial configuration and an extended configuration when the inflatable chambers are in an inflated configuration;

a valve arrangement selectively movable to a locked configuration wherein high pressure fluid may be locked in the inflatable chambers to maintain the tubular in the extended configuration;

and a shroud of at least one of the group consisting of a sand screen, a perforated tubular, an expandable screen, a hydraulically-extendable screen, a wire-wrapped screen, and a gravel pack screen, the shroud disposed around the inflatable chambers, the shroud comprising a filter cake-disrupting member including a plurality of slots defining a plurality of webs between the slots, wherein in the retracted configuration of the tubular, an outer surface of the filter cake-disrupting member is relatively smooth, and wherein in the extended configuration of the tubular, the webs are inclined such that the outer surface of the filter cake disrupting member is relatively jagged.

2. The downhole apparatus of claim 1, wherein the filter cake-disrupting member has a retracted configuration and an extended configuration.

3. The downhole apparatus of claim 2, wherein in the extended configuration of the filter cake disrupting member, disrupting portions of the webs of the filter cake-disrupting member extend radially beyond other portions of the filter cake-disrupting member.

4. The downhole apparatus of claim 1, wherein the outer surface of the filter cake-disrupting member defines a radially outermost surface of the tubular.

5. The downhole apparatus of claim 1, wherein the tubular comprises a swellable material arranged to swell upon exposure to any one of water, oil, and a hybrid mixture of water and oil, and the filter cake-disrupting member being at least one of coupled to and mounted on the swellable material such that upon swelling, the filter cake-disrupting member is activated.

6. The downhole apparatus of claim 1, comprising an isolation device for at least one of restricting, preventing, diverting, and controlling flow in a bore, wherein the isolation device is mounted on at least one of the tubular and a tubing component.

7. The downhole apparatus of claim 6, wherein the isolation device has a retracted configuration in which the isolation device is fixable in place on the tubular and an extended configuration in which the isolation device is fixable in place in a section of at least one of a wellbore and a casing, and the at least one of the tubular and the tubing component is movable through a bore of the isolation device.

8. The downhole apparatus of claim 7, wherein the isolation device comprises a seal element in the bore of the isolation device for providing a seal when the at least one of the tubular and the tubing component is provided in the bore of the isolation device, such that the seal element contacts the surface of the at least one of the tubular and the tubing component to provide the seal, thereby preventing fluid flow through the bore of the isolation device.

9. The downhole apparatus of claim 7, wherein the at least one of the tubular and the tubing component is joined to at least one of a further tubular and the tubing component, at least one of the tubular and the tubing component having the same cross-sectional profile such that joined components can be moved within or through the bore of the isolation device, without joints between the components impeding movement of the respective component through the bore of the isolation device.

10. A method of disturbing filter cake in a bore, the method comprising the steps of:

providing a tubular comprising a base pipe and a plurality of inflatable chambers mounted thereon and a shroud of at least one of the group consisting of a sand screen, a perforated tubular, an expandable screen, a hydraulically-extendable screen, a wire-wrapped screen, and a gravel pack screen disposed around the inflatable chambers, the shroud disposed around the inflatable chambers, the shroud comprising a filter cake-disrupting member including a plurality of slots defining a plurality of deformable webs between the slots, the webs defining an outer surface of similar radial extent when the tubular is in a retracted configuration;

locating the tubular in a bore at least partially lined with filter cake;

inflating the inflatable chambers with a pressurized fluid to activate the tubular to assume an extended configuration such that the deformable webs of the filter cake-disrupting member define an outer surface of varying radial extent to at least one of disturb or disrupt the filter cake;

deforming at least a portion of each web so as to move at least a portion of the webs radially with respect to other portions of the same web; and moving a valve arrangement to a locked configuration wherein the pressurized fluid is locked in the inflatable chambers to maintain the tubular in the extended configuration.

11. The method of claim 10, comprising the step of moving the filter cake-disrupting member relative to the bore to disrupt the filter cake.

12. The method of claim 11, comprising the step of moving the filter cake-disrupting member in at least one of an axial, radial, circumferential, rotational, reciprocal and oscillatory movement in the bore.

13. The method of claim 10, comprising the step of providing fluid flow in the bore to facilitate at least one of disruption and removal of the filter cake.

14. The method of claim 13, comprising the step of combining fluid flow with mechanical movement of the filter cake-disrupting member to at least one of disrupt or remove the filter cake.

15. The method of claim 10, wherein the outer surface of varying radial extent defines a jagged or toothed profile.

16. The method of claim 10, comprising the steps of at least one of moving the tubular in an axial direction within the bore and reciprocating the tubular within the bore.

17. The method of claim 10, comprising the steps of at least one of rotating the tubular within the bore and moving the tubular at least one of axially, reciprocally and rotationally within the bore.

18. The method of claim 10, comprising the step of varying downhole conditions in the bore such that a formation adjacent the bore produces fluid.

19. The method of claim 18, comprising the step of disrupting or removing the filter cake from the bore to at least one of control, optimize, and increase the rate of fluid flow produced by the formation.

20. The method of claim 18, comprising the steps of providing fluid flow by at least one of: varying a downhole condition, controlling a downhole condition, pumping fluid downhole, allowing fluid to flow from the formation, and allowing fluid to flow into the formation.

21. The method of claim 10, comprising the steps of providing a fluid for at least one of facilitating, disturbing, disrupting, removing, and breaking-down of the filter cake, and locating the fluid in the bore.

22. The method of claim 21, comprising the steps of providing the fluid with an abrasive fluid and providing fluid flow to provide abrasive action of the fluid to facilitate at least one of break-down and removal of the filter cake from the bore wall.

23. The method of claim 21, comprising the step of providing the fluid with a chemical for at least one of breaking-down, assisting to break-down, and dissolving the filter cake.

24. The method of claim 20, comprising the steps of mounting the isolation device on at least one of the tubular and a tubing component, and using the isolation device to at least one of restrict, prevent, divert, and control flow in the annulus between the at least one of the tubular, the tubing component, and a wall of the bore.

25. The method of claim 24, comprising the steps of providing the isolation device in a retracted configuration in which the isolation device is fixed in place on the at least one of the tubular and the tubing component, locating the isolation device in a section of at least one of a wellbore and casing, and activating the isolation device to fix the isolation device in place in the section of the at least one of the wellbore and casing, thereby restricting flow through the annulus between the at least one of the tubular, the tubing component, and a wall of the bore.

26. The method of claim 25, comprising the step of moving the at least one of the tubular and the tubing component through a bore of the isolation device once the isolation device is fixed in place in the section of the at least one of the wellbore and the casing.

27. The method of claim 25, comprising the steps of activating the isolation device in a section of the bore lined with casing to prevent fluid from at least one of migrating and flowing from the lined section of the bore to an unlined section of the bore.

28. A method of disturbing filter cake in a bore, the method comprising the steps of:

providing an apparatus comprising a base pipe, a plurality of inflatable chambers mounted externally of the base pipe, a shroud of at least one of the group consisting of a sand screen, a perforated tubular, an expandable screen, a hydraulically-extendable screen, a wire-wrapped screen, and a gravel pack screen disposed around the inflatable chambers, the shroud disposed around the inflatable chambers, the shroud comprising a filter cake-disrupting member including a plurality of slots defining a plurality of deformable webs between the slots, the webs defining an outer surface of similar radial extent when the filter cake-disrupting member is in a retracted configuration;

locating the apparatus in a bore at least partially lined with filter cake;

inflating the inflatable chambers with a pressurized fluid to extend the filter cake-disrupting member to an extended configuration;

deforming at least a portion of the each deformable web so as to move at least a portion of the each deformable web radially with respect to other portions of the same deformable web such that the filter cake-disrupting member defines an outer surface of varying radial extent in the extended configuration;

at least one of disturbing and disrupting at least some of the filter cake by moving the filter cake-disrupting member relative to the bore; and locking the pressurized fluid in the inflatable chambers to maintain the filter cake disrupting member in an extended configuration.

* * * * *